United States Patent [19]

Umehara et al.

[11] Patent Number: 4,868,080

[45] Date of Patent: Sep. 19, 1989

[54] ELECTROPHOTOGRAPHIC PHOTOSENSITIVE MEMBER COMPRISING AROMATIC AZO PIGMENT CONTAINING CYCLIC AMINO GROUP

[75] Inventors: Shoji Umehara, Yokohama; Yoshio Kashizaki, Tokyo, both of Japan

[73] Assignee: Canon Kabushiki Kaisha, Tokyo, Japan

[21] Appl. No.: 127,046

[22] Filed: Nov. 27, 1987

[30] Foreign Application Priority Data

Dec. 3, 1986 [JP] Japan ..... 61-286712

[51] Int. Cl.[4] ..... G03G 5/06; G03G 5/14

[52] U.S. Cl. ..... 430/73; 430/58

[58] Field of Search ..... 430/72, 58

[56] References Cited

U.S. PATENT DOCUMENTS 4,657,834 4/1987 Tachiko et al. ..... 430/58

*Primary Examiner*—J. David Welsh

*Attorney, Agent, or Firm*—Fitzpatrick, Cella, Harper & Scinto

[57] ABSTRACT

An electrophotographic photosensitive member has a photosensitive layer on an electroconductive support, characterized in that the photosensitive member contains an azo pigment having an organic residue represented by the formula (I).

15 Claims, No Drawings

ELECTROPHOTOGRAPHIC PHOTOSENSITIVE MEMBER COMPRISING AROMATIC AZO PIGMENT CONTAINING CYCLIC AMINO GROUP

BACKGROUND OF THE INVENTION

1. Field of the Invention

This invention relates to an electrophotographic photosensitive member, particularly to an electrophotographic photosensitive member having a photosensitive layer containing a novel azo pigment.

2. Related Background Art

Heretofore, electrophotographic photosensitive members utilizing inorganic photoconductive members such as selenium, cadmium sulfide, zinc oxide, etc. have been known.

On the other hand, since discovery of specific organic compounds which exhibit photoconductivity, a large number of organic photoconductive members have been developed. For example, there have been known organic photoconductive polymers such as poly-N-vinylcarbazole, polyvinylanthracene, etc.; low molecular weight organic photoconductive members such as carbazole, anthracene, pyrazolines, hydrazones, arylalkanes, etc.; or organic pigments or dyes such as phthalocyanine pigments, azo pigments, cyanine pigments, polycyclic quinone pigments, perylene type pigments, indigo dyes, thioindigo dyes or squaric acid methine dyes, etc.

Particularly, organic pigments or dyes having photoconductivity can be synthesized more easily as compared with inorganic materials. Further, flexibility capable of selecting a compound exhibiting photoconductivity at a suitable wavelength region has been expanded. Therefore, a large number of photoconductive organic pigments and dyes have been proposed. For example, there have been known electrophotographic photosensitive members by use of azo pigments exhibiting photoconductivity as the charge generation substance in the photoconductive layer which is separated into functions of the charge generation layer and the charge transport layer, as disclosed in U.S. Pat. Nos. 4123270, 4247614, 4251613, 4251614, 4256821, 4260672, 4268596, 4278747 and 4293628.

Also, azo pigments as disclosed in U.S. Pat. Nos. 4279981, 4352876, 4356243, 4390611, 4418133, 4436800, 4439506, 4447513, 4471040, 4495264, 4551404, 4571369, 4582771, 4599287 and 4600674 have been known as the charge generation substance in the photosensitive layer.

Since the electrophographic photosensitive member by use of such organic photoconductive members can be produced by coating by selecting suitably a binder, they have the advantages such that photosensitive members can be provided with extremely high productivity at low cost, and yet that the photosensitive wavelength region can be freely controlled, and therefore practical application thereof is under rapid progress in recent years.

However, such photosensitive members of the prior art can not be said to be satisfactory with respect to sensitivity and repetition characteristic, and most of their uses are limited to low grade electrophotographic copying machines, etc. under the present situation.

SUMMARY OF THE INVENTION

An object of the present invention is to provide an electophotographic photosensitive member having practically high sensitivity.

Another object of the present invention is to provide an electrophotographic photosensitive member having stable potential characteristic in repeated uses.

Further object of the present invention is to provide an electrophotographic photosensitive member provided with long wavelength sensitivity having sufficient sensitivity also in laser wavelength region.

According to the present invention, there is provided an electrophotographic photosensitive member having a photosensitive layer on an electroconductive support, characterized in that the photosensitive member contains an azo pigment having an organic residue represented by the formula:

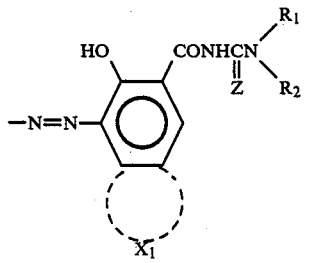

(I)

wherein $X_1$ represents a residue necessary for forming an aromatic hydrocarbon ring or an aromatic heterocyclic ring which may have substituent through fusion with the benzene ring;

$R_1$ and $R_2$, which may be identical or different, each represent hydrogen atom, an alkyl, aralkyl, aryl or heterocyclic group which may have substituent, or $R_1$ and $R_2$ represent a cyclic amino group containing the nitrogen atom to which $R_1$ and $R_2$ are bonded within the ring;

Z represents oxygen atom or sulfur atom.

DESCRIPTION OF THE PREFERRED EMBODIMENTS

To describe about the organic residue represented by the above formula (I), in the formula, $X_1$ is an organic residue necessary for formation of an aromatic hydrocarbon ring or an aromatic heterocyclic ring which may have substituent such as naphthalene ring, anthracene ring, carbazole ring, benzocarbazole ring, dibenzofuran ring, benzonaphthafuran ring, fluorenone ring, etc. through fusion with the benzene ring, and examples of substituent may include alkyl groups such as methyl, ethyl, etc., alkoxy groups such as methoxy, ethoxy, etc., halogen atoms such as fluorine, chlorine, bromine, iodine atoms, halomethyl groups such as trifluoromethyl, etc., nitro group and cyano group.

Specific examples of the formula (I) may include the structural formulae shown below:

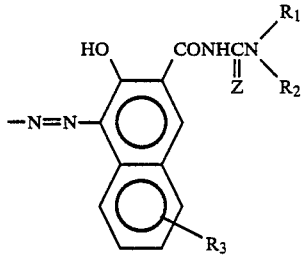

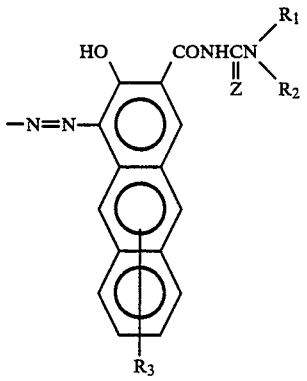

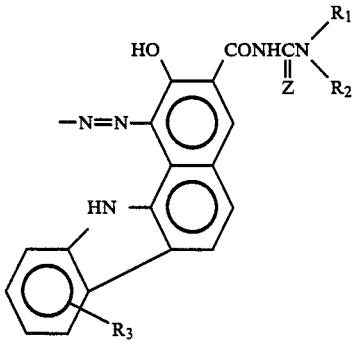

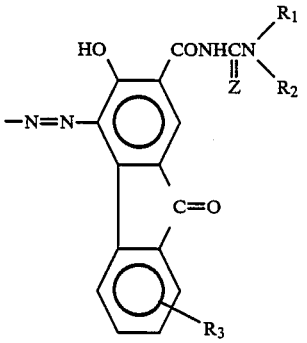

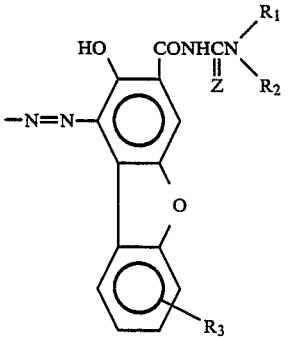

-continued

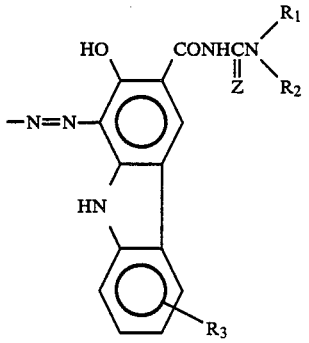

wherein $R_3$ represents a substituent as described above.

In the formula (I), $R_1$ and $R_2$ each represent hydrogen atom, an alkyl group such as methyl, ethyl, propyl, butyl and the like, an aralkyl group such as benzyl, phenethyl, naphthylmethyl and the like, an aryl group such as phenyl, diphenyl, naphthyl, anthryl and the like, a heterocyclic group such as pyridyl, thienyl, furyl, thiazolyl, carbazolyl, dibenzofuryl, benzoimidazolyl, benzothiazolyl and the like, which may have substituent, or $R_1$ and $R_2$ represent a cyclic amino group containing the nitrogen atom to which $R_1$ and $R_2$ are bonded within the ring, and examples of the substituent possesed by the above alkyl group may include halogen atoms such as fluorine, chlorine, bromine and iodine atoms, nitro group, cyano group; examples of the substituent possessed by the aralkyl, aryl or heterocyclic group may include alkyl groups such as methyl, ethyl, propyl, etc., alkoxy groups such as methoxy, ethoxy, etc., halogen atoms such as fluorine, chlorine, bromine and iodine atoms, alkylamino groups such as dimethylamino, diethylamino, etc., phenylcarbamoyl group, nitro group, cyano group, halomethyl groups such as trifluoromethyl, etc.

As the cyclic amino group containing nitrogen atom within the ring, there may be included cyclic amino groups derived from pyrrole, pyrroline, porrolidine, pyrrolidone, indole, indoline, isoindole, carbazole, benzoindole, imidazole, pyrazole, pyrazoline, oxazine, phenoxazine, benzocarbazole, etc.

As the substituent on the above cyclic amino group, there may be included alkyl groups such as methyl, ethyl, propyl and the like, alkoxy groups such as methoxy, ethoxy and the like, halogen atoms such as fluorine, chlorine, bromine and iodine atoms, nitro group, cyano group, halomethyl groups such as trifluoromethyl, etc.

As described below, with respect to hydrogen bond capacity between pigment molecules, $R_1$ should be preferably hydrogen atom. Further, when $R_1$ is hydrogen atom, $R_2$ is preferably alkyl group, aralkyl group or aryl group. Among them, aryl group which may have a substituent is preferable, and particularly, phenyl group which may have a substituent shows the effect for obtaining the highest sensitivity and excellent durability.

Z represents oxygen atom or sulfur atom.

As the aromatic hydrocarbon ring or the aromatic heterocyclic ring which may have substituent which may be bonded through a bonding group, to which the organic residue represented by the formula (I) is bonded, there may be included hydrocarbon type aromatic rings such as benzene, naphthalene, fluorene, phenanthrene, anthracene, pyrene, etc.; heterocyclic aromatic rings such as furan, thiophene, pyridine, indole, benzothiazole, carbazole, acridone, dibenzothiophene, benzooxazole, benzotriazole, oxadiazole, thiazole, etc.; and further those having the above aromatic rings bonded directly or bonded through an aromatic group or a non-aromatic group such as triphenylamine, diphenylamine, N-methyldiphenylamine, biphenyl, terphenyl, binaphthyl, fluorenone, phenanthrenequinone, anthraquinone, benzoanthrone, diphenyloxadiazole, phenylbenzooxazole, diphenylmethane, diphenylsulfone, diphenyl ether, benzophenone, stilbene, distyrylbenzene, tetraphenyl-p-phenylenediamine, tetraphenylbenzidine, etc.

As the above substituent which may be bonded through a bonding group which may be possessed by the aromatic hydrocarbon or the aromatic heterocyclic group, there may be included alkyl groups such as methyl, ethyl, propyl, butyl and the like, alkoxy groups such as methoxy, ethoxy and the like, dialkylamino groups such as dimethylamino, diethylamino and the like, halogen atoms such as fluorine, chlorine, bromine atoms, hydroxy group, nitro group, cyano group, halomethyl groups and substituted azo groups represented by the formula —N=N—Cp (III), and Cp in the above formula represents a coupler residue having phenolic OH group. More particularly, those having the structures shown below may be included.

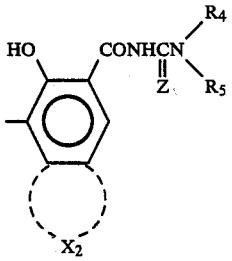

(IV)

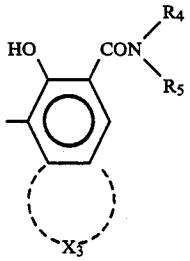

(V)

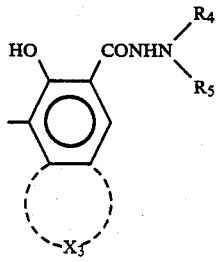

(VI)

-continued

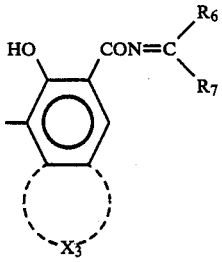

(VII)

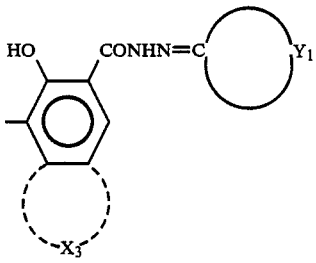

(VIII)

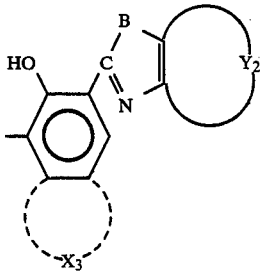

(IX)

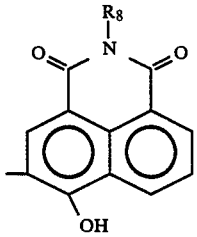

(X)

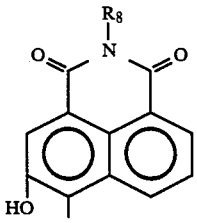

(XI)

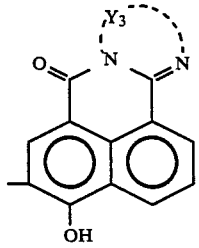

(XII)

-continued (XIII)

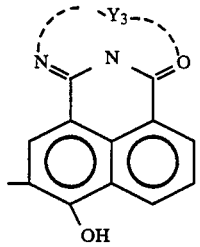

(XIV)

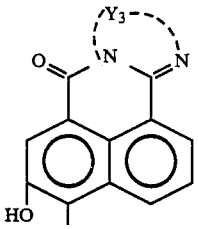

(XV)

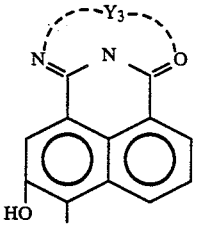

In the above formula, $X_2$ represents an organic residue necessary for formation of an aromatic hydrocarbon ring or an aromatic heterocyclic ring which may have substituent such as naphthalene ring, anthracene ring, carbazole ring, benzocarbazole ring, dibenzofuran ring, benzonaphthofuran ring, fluorenone ring, etc. through fusion with the benzene ring.

$X_3$ represents an organic residue necessary for formation of an aromatic hydrocarbon ring or an aromatic heterocyclic ring which may have substituent such as naphthalene ring, anthracene ring, carbazole ring, benzocarbazole ring, dibenzofuran ring, benzonaphthofuran ring, diphenylenesulfide ring, quinoline ring, isoquinoline ring, acridine ring, etc. through fusion with the benzene ring.

$R_4$ and $R_5$, which may be identical or different, each represent hydrogen atom, alkyl, aralkyl, aryl or heterocyclic group which may have substituent, or taken together represent a cyclic amino group containing the nitrogen atom to which $R_4$ and $R_5$ are bonded within the ring.

$R_6$ and $R_7$, which may be identical or different, each represent hydrogen atom, alkyl, aralkyl, aryl or heterocyclic group which may have substituent.

R8 represents alkyl, aralkyl, aryl or heterocyclic group which may have substituent.

$Y_1$ represents a divalent hydrocarbon group or a heterocyclic group.

As the $=CY_1$ containing $Y_1$, there may be included:

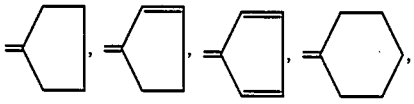

-continued

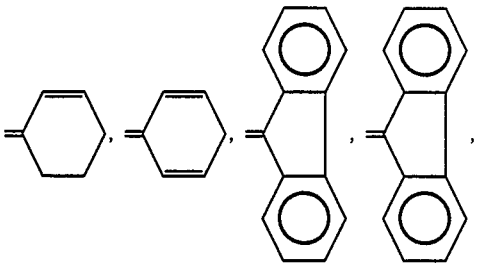

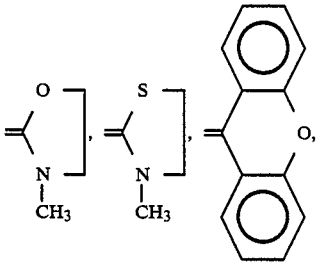

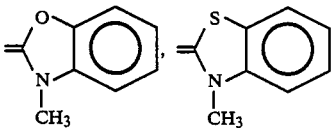

$Y_2$ represents a divalent aromatic hydrocarbon ring which may have substituent, including o-phenylene, o-naphthylene, perynaphthylene, 1,2-anthrylene, 9,10-phenanthrylene group, etc.

$Y_3$ represents a divalent aromatic hydrocarbon ring which may have substituent or a divalent heterocyclic ring containing nitrogen atom within the ring, and examples of the divalent aromatic hydrocarbon ring may include o-phenylene, o-naphthylene, perynaphthylene, 1,2-anthrylene, 9,10-phenanthrylene, etc., while examples of the divalent heterocyclic group containing nitrogen atom within the ring may include 3,4-pyrazolediyl, 2,3-pyridinediyl, 4,5-pyrimidinediyl, 6,7-indazolediyl, 5,6-benzoimidazolediyl, 6,7-quinolinediyl groups, etc.

B represents oxygen atom, sulfur atom, N-substituted or unsubstituted imino group, and the substituent on N represents alkyl, aralkyl or aryl group which may have substituent.

Z represents oxygen atom or sulfur atom.

The alkyl group as represented above may include methyl, ethyl, propyl, butyl and the like; the aralkyl group, benzyl, phenethyl, naphthylmethyl and the like; the aryl group phenyl, diphenyl, naphthyl, anthryl and the like; the heterocyclic group pyridyl, thienyl, furyl, thiazolyl, carbazolyl, dibenzofuryl, benzoimidazolyl, benzothiazolyl and the like; and the cyclic amino group containing nitrogen atom within the ring those derived from pyrrole, pyrroline, pyrrolidine, pyrrolidone, indole indoline, isoindole, carbazole, benzoindole, imidazole, pyrazole, pyrazoline, oxazine, phenoxazine, benzocarbazole, etc.

Also, as the substituent, there may be included alkyl groups such as methyl, ethyl, propyl and the like, alkoxy groups such as methoxy, ethoxy and the like, halogen atoms such as fluorine, chlorine, bromine and iodine atoms, alkylamino groups such as dimethylamino, diethylamino and the like, phenylcarbamoyl group, nitro group, cyano group, halomethyl groups such as trifluoromethyl, etc.

In the following, representative examples of the azo pigments used in the present invention are enumerated.

For the list, the azo pigments represented by the following formula (II) were used as the basic type.

These azo pigments are classified according to the number of n and the organic residue portion represented by the formula (I) is represented as A.

(II)

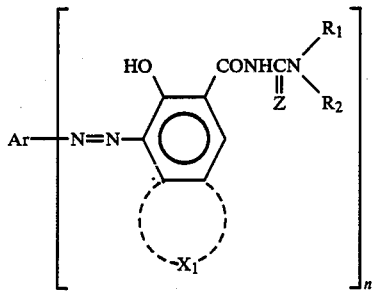

In the above formula, $X_1$, $R_1$, $R_2$ and Z have the same meanings as in the formula (I), Ar represents an aromatic hydrocarbon ring or an aromatic heterocyclic ring which may have substituent which may be bonded through a bonding group (the same meaning as the above group to which the organic residue shown by the formula (I) is to be bonded), and n represents an integer of 1, 2, 3 or 4.

The above basic type was classified into the type of n=1, the type of n=2, the type of n=3 and the type of n=4 and listed below.

| (Type of n = 1) | A |
|---|---|
| Exemplary pigment (1)-1 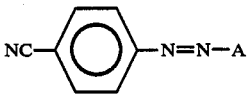 | 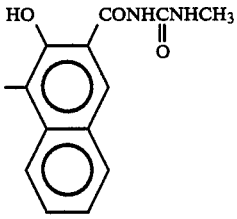 |
| Exemplary pigment (1)-2 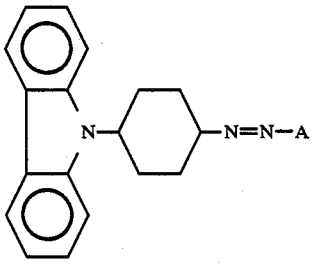 | 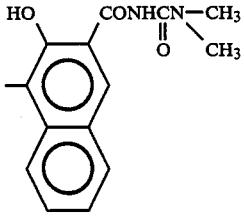 |
| Exemplary pigment (1)-3 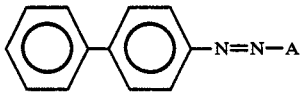 | 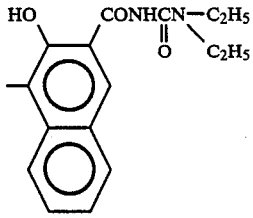 |
| Exemplary pigment (1)-4 | |

-continued
| (Type of n = 1) | A |
|---|---|
| 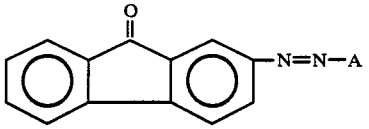 | 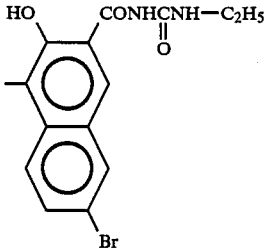 |
| Exemplary pigment (1)-5 | |
| 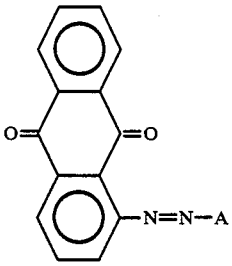 | 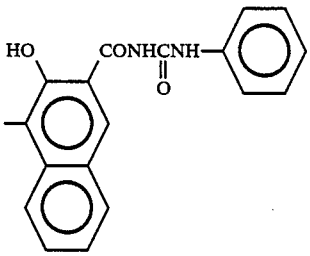 |
| Exemplary pigment (1)-6 | |
| 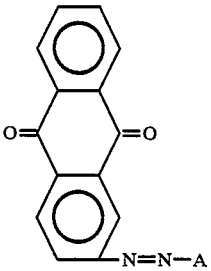 | 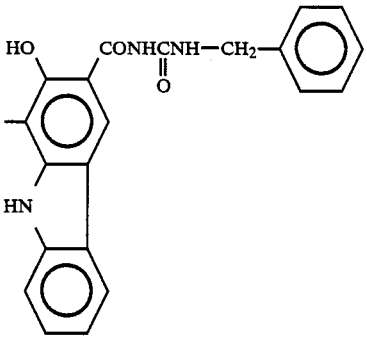 |
| Exemplary pigment (1)-7 | |
| 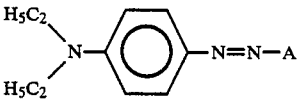 | 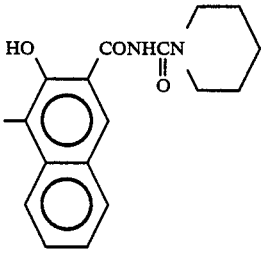 |
| Exemplary pigment (1)-8 | |
| 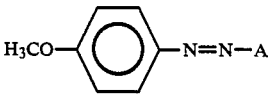 | 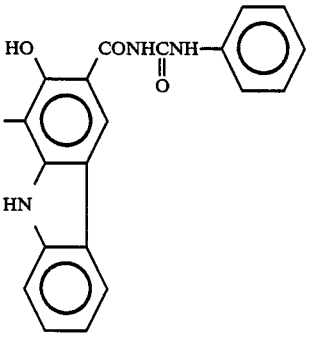 |
| Exemplary pigment (1)-9 | |

-continued
| (Type of n = 1) | A |
|---|---|
| 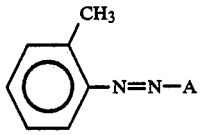 | 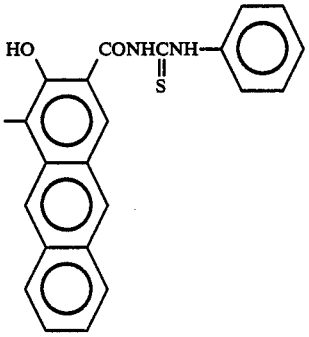 |
Exemplary pigment (1)-10
| | |
|---|---|
| 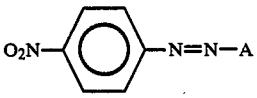 | 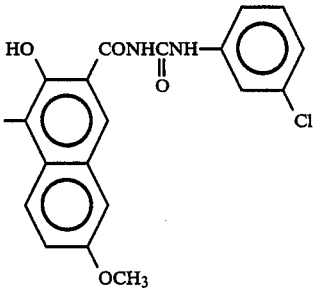 |
Exemplary pigment (1)-11
| | |
|---|---|
| 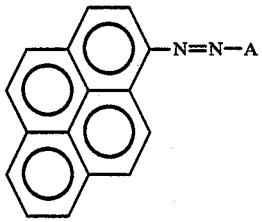 | 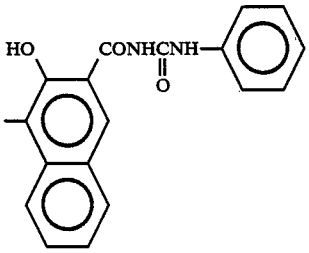 |
Exemplary pigment (1)-12
| | |
|---|---|
| 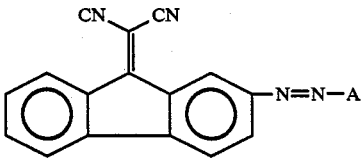 | 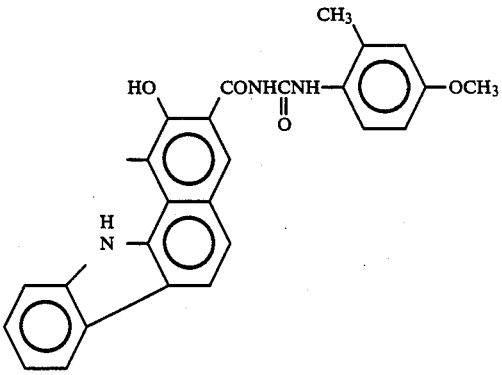 |
Exemplary pigment (1)-13

-continued
| (Type of n = 1) | A |
|---|---|
| 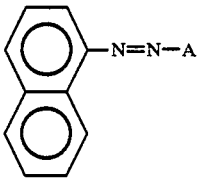 | 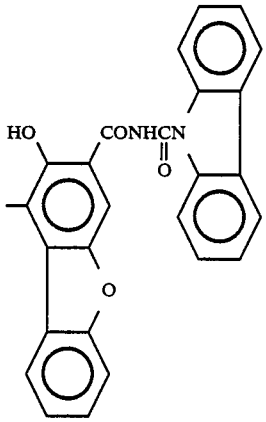 |
Exemplary pigment (1)-14
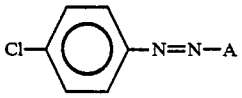
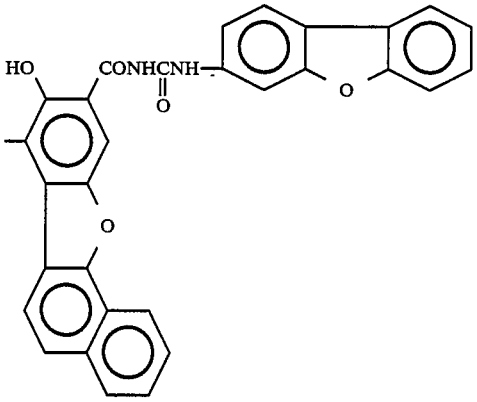
Exemplary pigment (1)-15
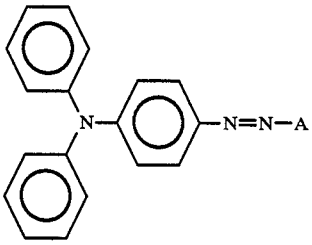
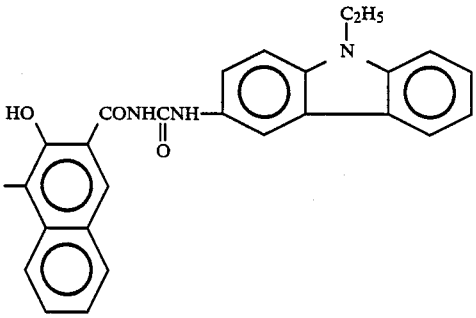
Exemplary pigment (1)-16
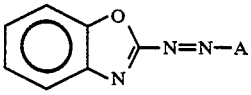
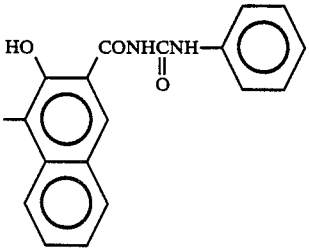
Exemplary pigment (1)-17

-continued
| (Type of n = 1) | A |
|---|---|
| 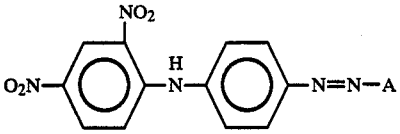 | 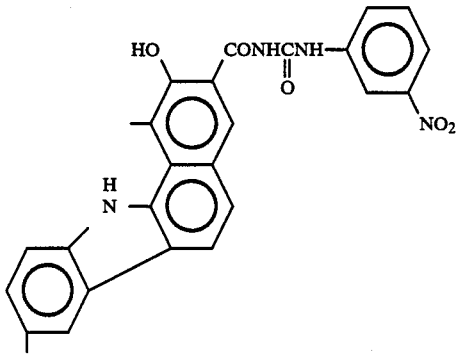 |
| Exemplary pigment (1)-18 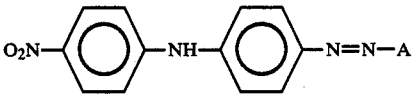 | 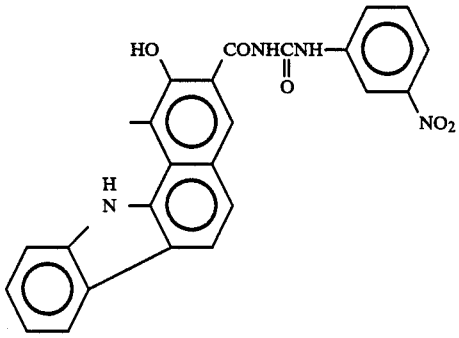 |
| Exemplary pigment (1)-19 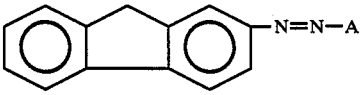 | 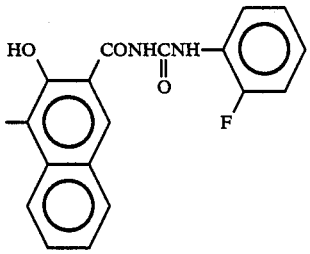 |
| Exemplary pigment (1)-20 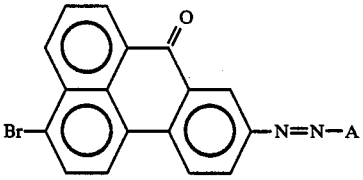 | 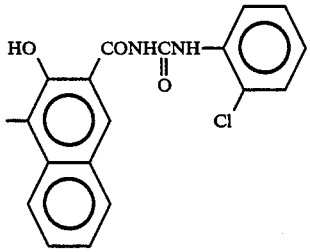 |
| Exemplary pigment (1)-21 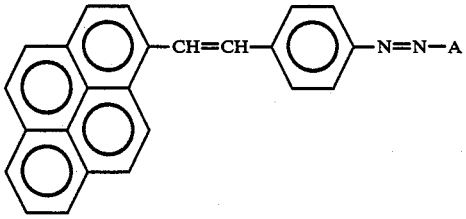 | 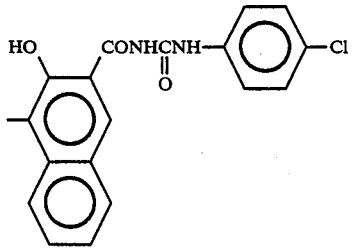 |

| (Type of n = 2) | A |
|---|---|
| Exemplary pigment (2) - 1 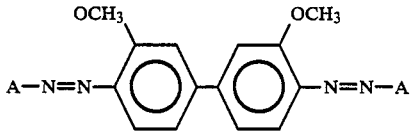 | 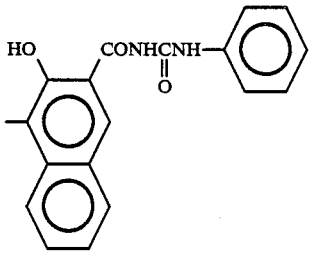 |
| Exemplary pigment (2) - (2) same as (2) - 1 | 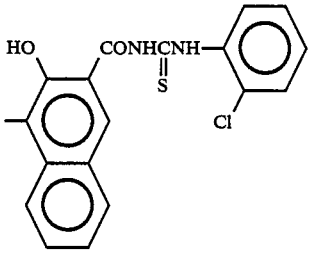 |
| Exemplary pigment (2) - 3 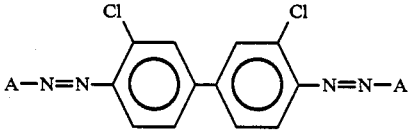 | 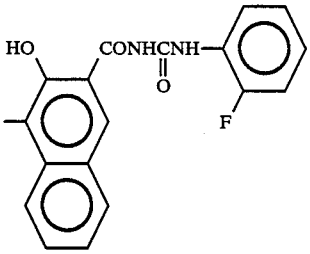 |
| Exemplary pigment (2) - 4 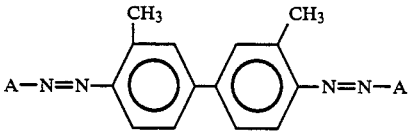 | 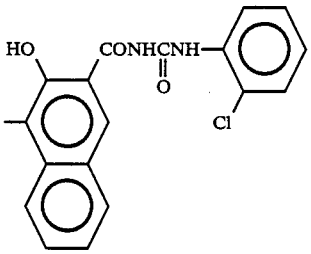 |
| Exemplary pigment (2) - 5 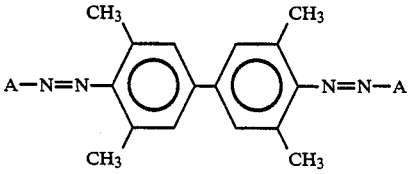 | 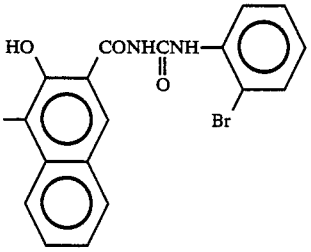 |
| Exemplary pigment (2) - 6 | |

-continued
| (Type of n = 2) | A |
|---|---|
| 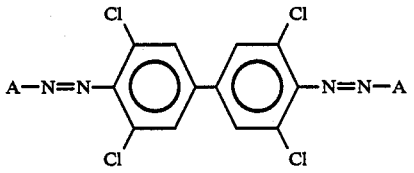 | 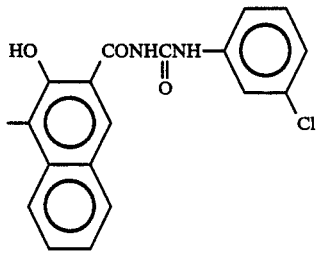 |
Exemplary pigment (2) - 7
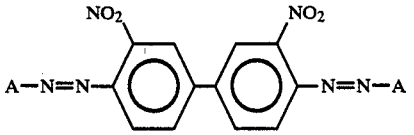
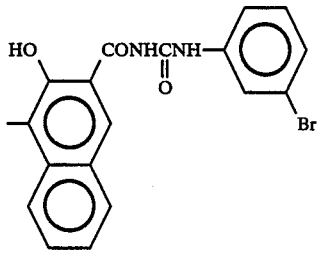
Exemplary pigment (2) - 8
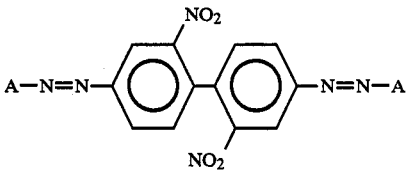
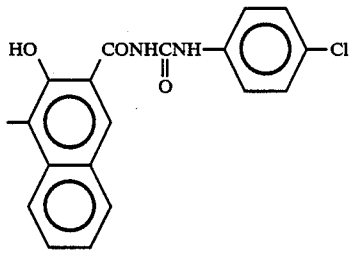
Exemplary pigment (2) - 9
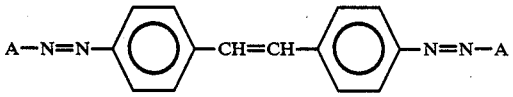
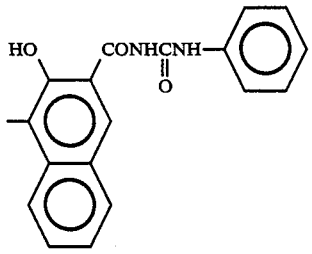
Exemplary pigment (2) - 10
same as (2) - 9
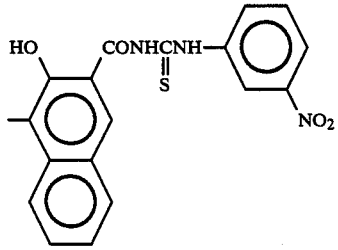
Exemplary pigment (2) - 11

-continued
| (Type of n = 2) | A |
|---|---|
| 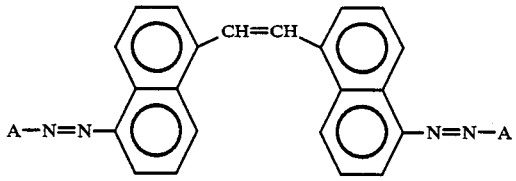 | 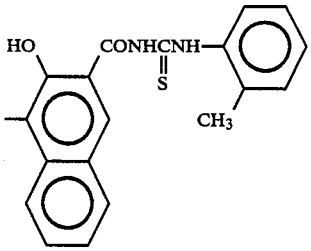 |
Exemplary pigment (2) - 12
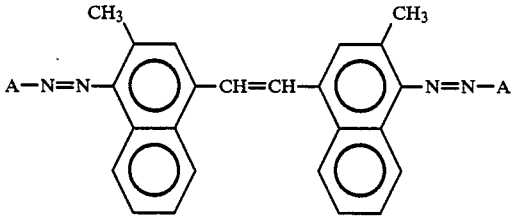
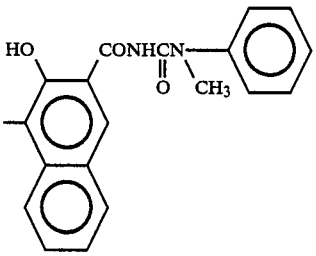
Exemplary pigment (2) - 13
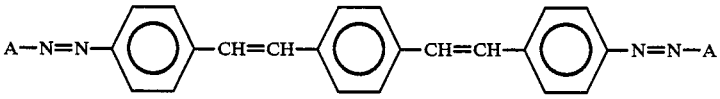
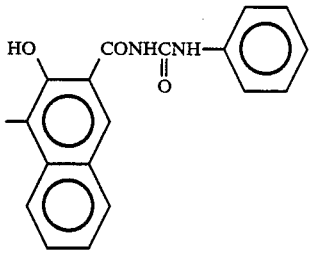
Exemplary pigment (2) - 14
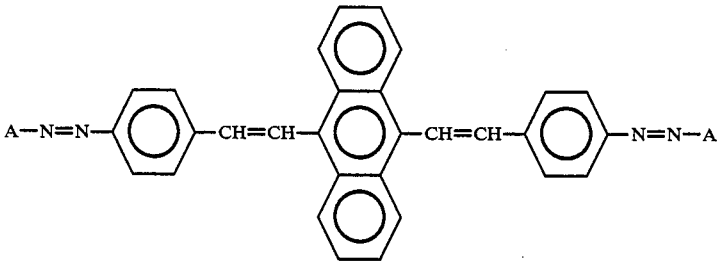
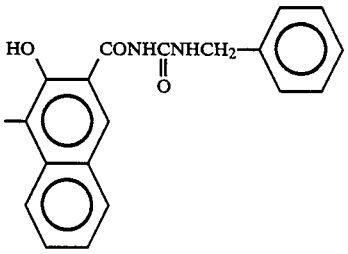
Exemplary pigment (2) - 15

-continued
| (Type of n = 2) | A |
|---|---|
| 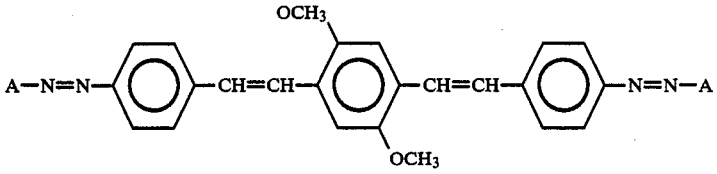 | 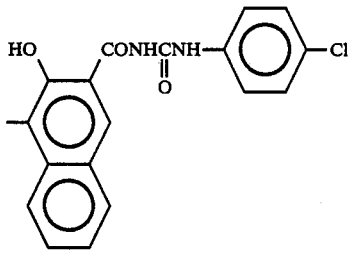 |
Exemplary pigment (2) - 16
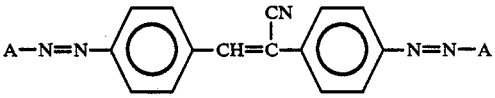
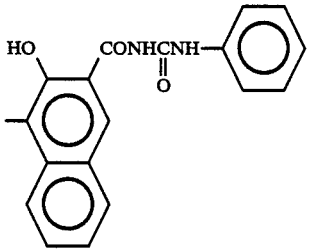
Exemplary pigment (2) - 17
same as (2) -16
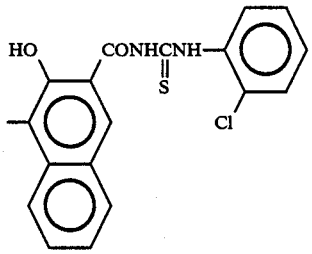
Exemplary pigment (2) - 18
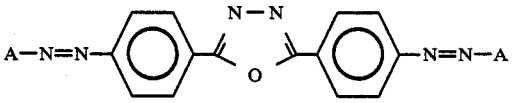
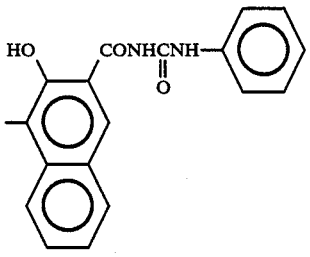
Exemplary pigment (2) - 19
same as (2) - 18
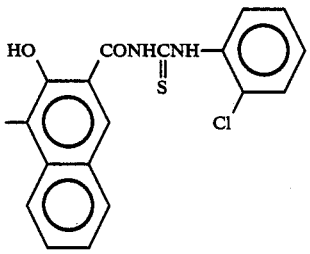
Exemplary pigment (2) - 20

-continued
| (Type of n = 2) | A |
|---|---|
| 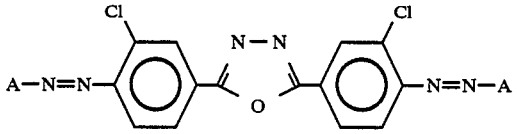 | 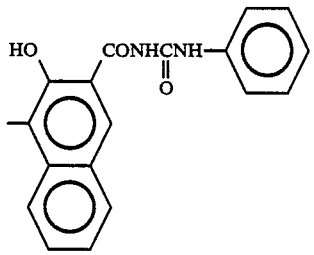 |
Exemplary pigment (2) - 21
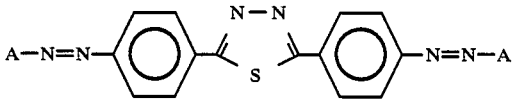
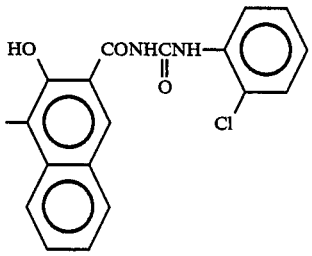
Exemplary pigment (2) - 22
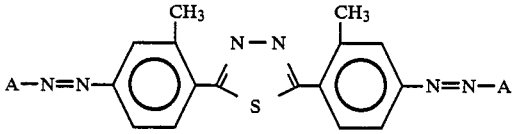
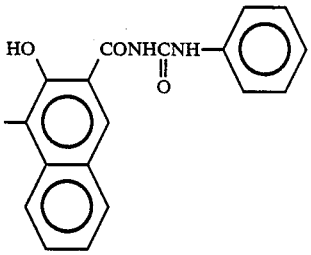
Exemplary pigment (2) - 23
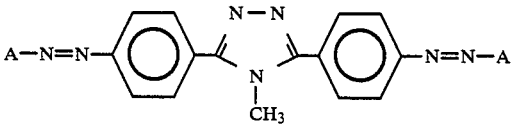
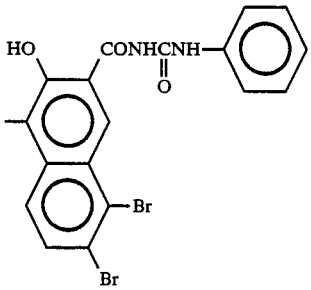
Exemplary pigment (2) - 24
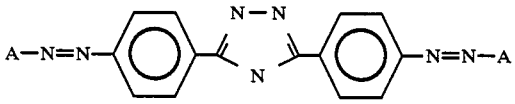
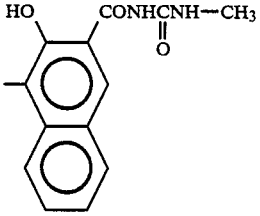
Exemplary pigment (2) - 25

-continued
| (Type of n = 2) | A |
|---|---|
| 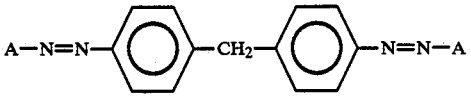 | 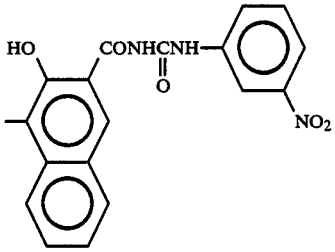 |
| Exemplary pigment (2) - 26 | |
| 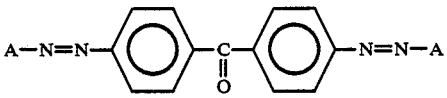 | 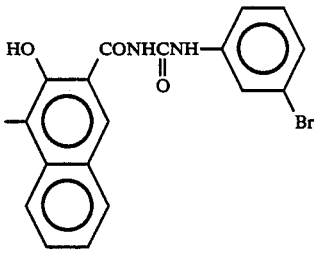 |
| Exemplary pigment (2) - 27 | |
| 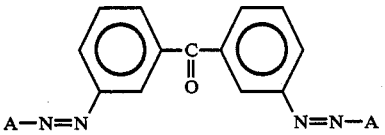 | 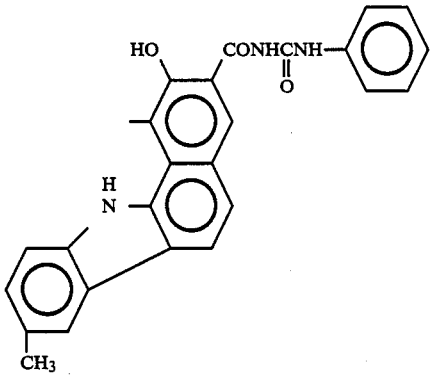 |
| Exemplary pigment (2) - 28 | |
| 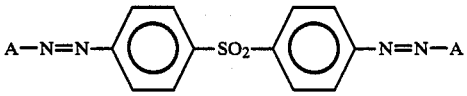 | 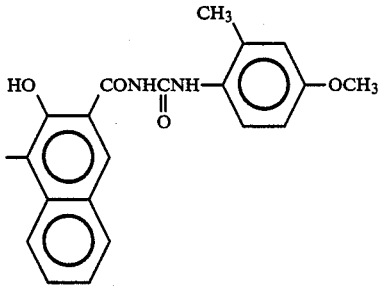 |
| Exemplary pigment (2) - 29 | |
| 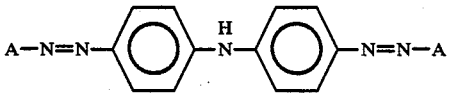 | 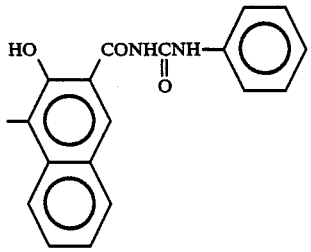 |
| Exemplary pigment (2) - 30 | |

-continued
| (Type of n = 2) | A |
|---|---|
| same as (2) - 29 | 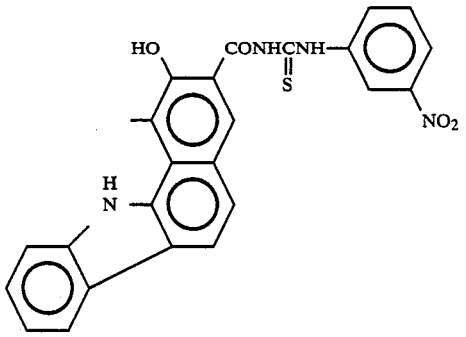 |
Exemplary pigment (2) - 31
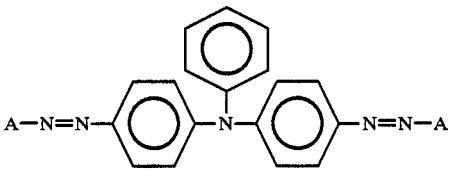
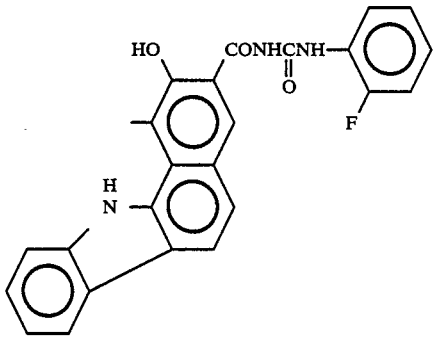
Exemplary pigment (2) - 32
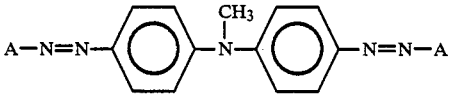
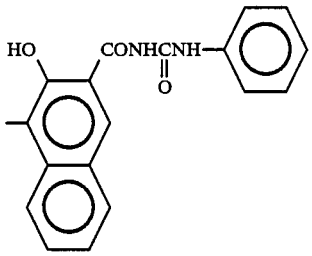
Exemplary pigment (2) - 33
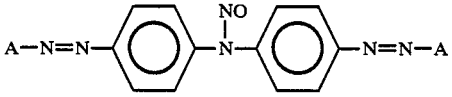
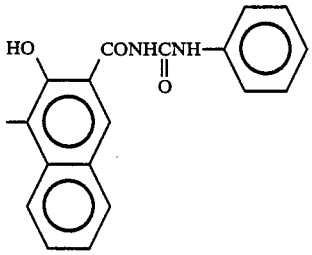
Exemplary pigment (2) - 34
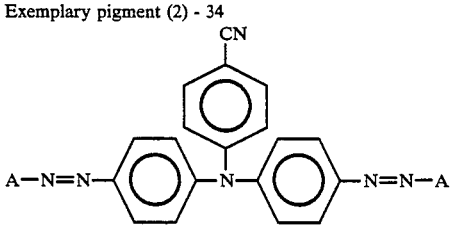
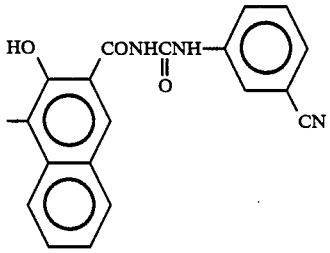
Exemplary pigment (2) - 35

-continued
| (Type of n = 2) | A |
|---|---|
| 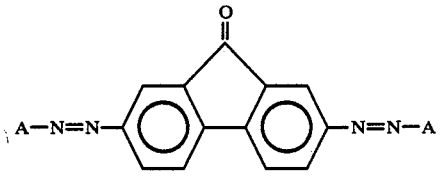 | 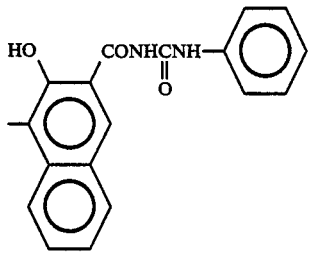 |
| Exemplary pigment (2) - 36<br>same as (2) - 35 | 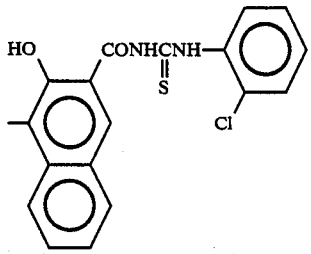 |
| Exemplary pigment (2) - 37<br> 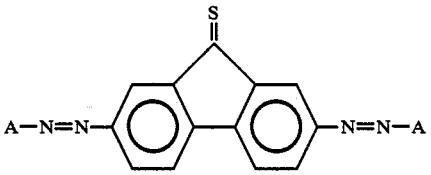 | 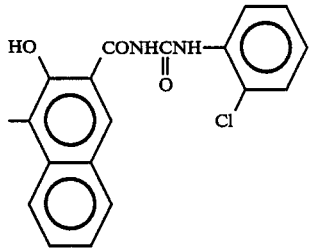 |
| Exemplary pigment (2) - 38<br> 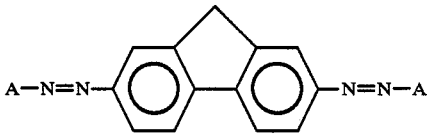 | 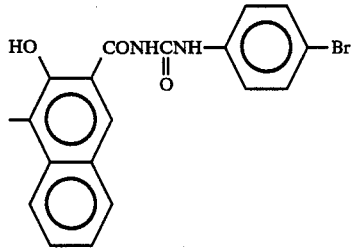 |
| Exemplary pigment (2) - 39<br> 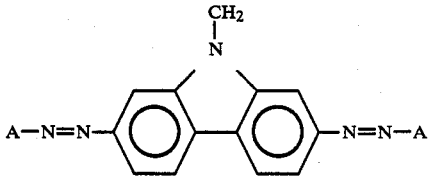 | 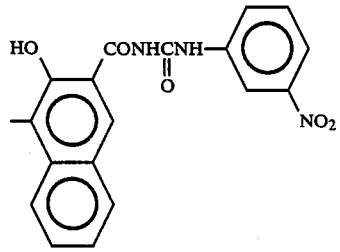 |
| Exemplary pigment (2) - 40 | |

-continued
| (Type of n = 2) | A |
|---|---|
| 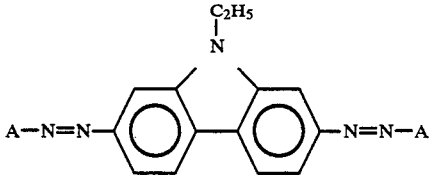 | 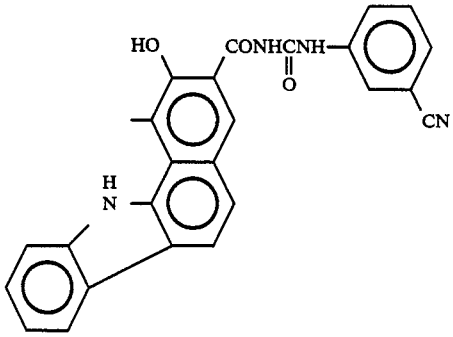 |
| Exemplary pigment (2) - 41 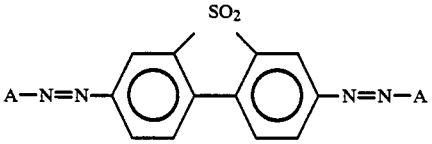 | 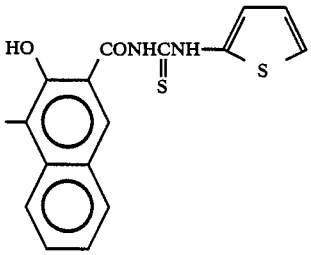 |
| Exemplary pigment (2) - 42 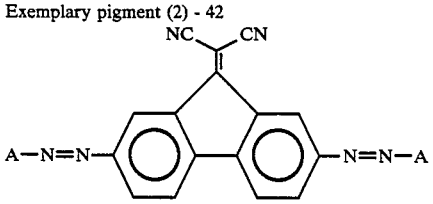 | 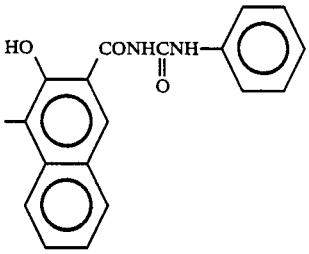 |
| Exemplary pigment (2) - 43 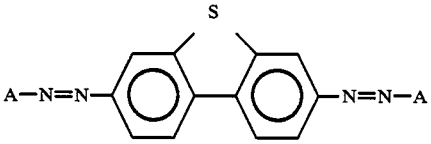 | 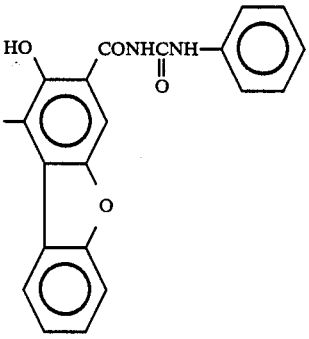 |
| Exemplary pigment (2) - 44 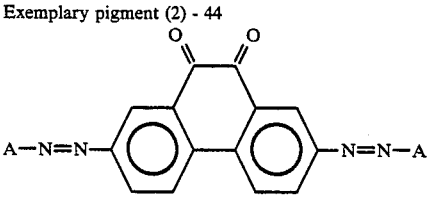 | 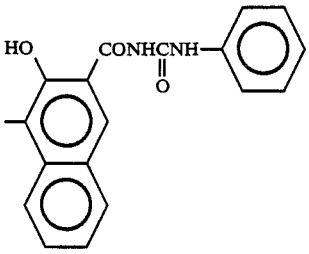 |
| Exemplary pigment (2) - 45 | |

-continued
| (Type of n = 2) | A |
|---|---|
| 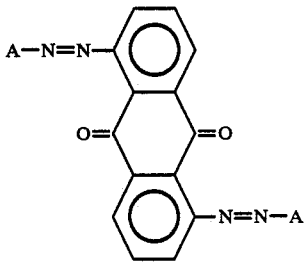 | 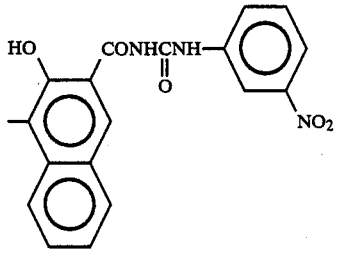 |
| Exemplary pigment (2) - 46 | |
| 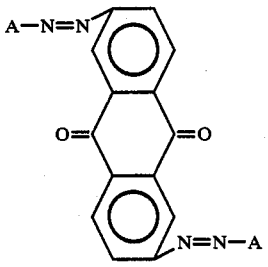 | 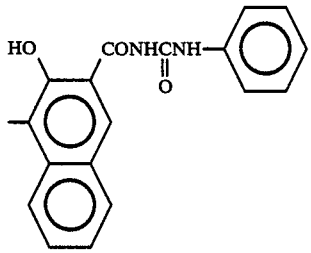 |
| Exemplary pigment (2) - 47 | |
| 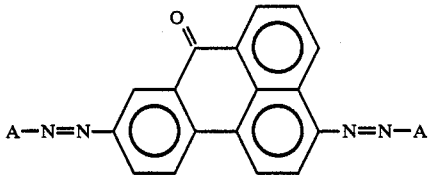 | 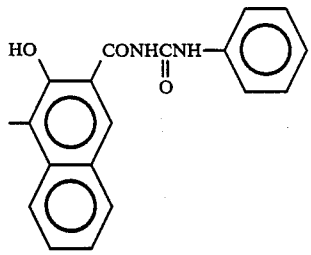 |
| Exemplary pigment (2) - 48<br>same as (2) - 47 | 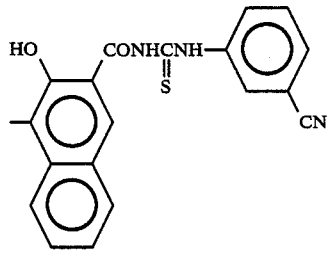 |
| Exemplary pigment (2) - 49 | |
| 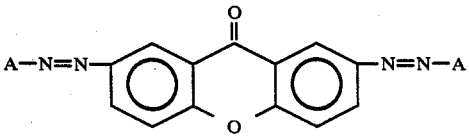 | 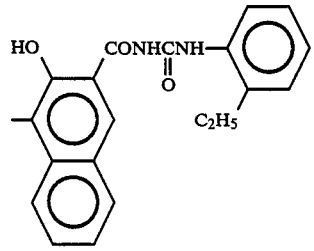 |
| Exemplary pigment (2) - 50 | |

-continued
| (Type of n = 2) | A |
|---|---|
| 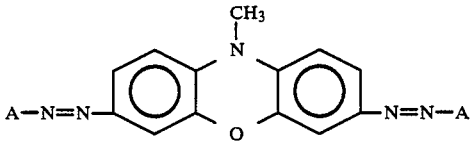 | 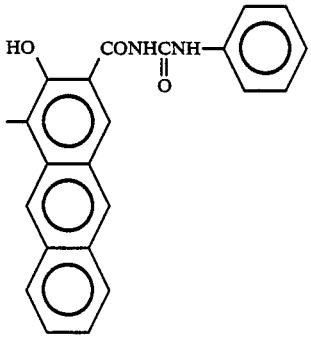 |
Exemplary pigment (2) - 51
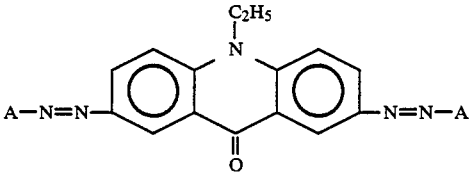
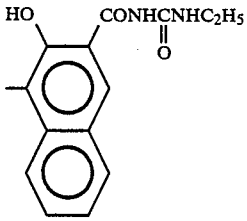
Exemplary pigment (2) - 52
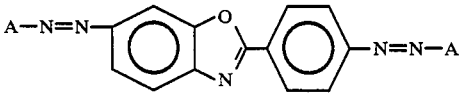
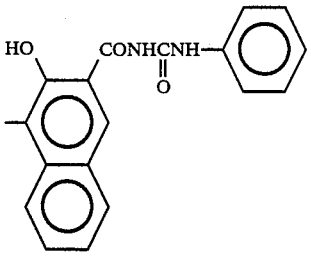
Exemplary pigment (2) - 53
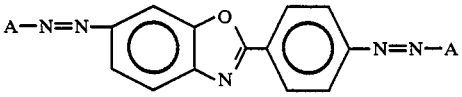
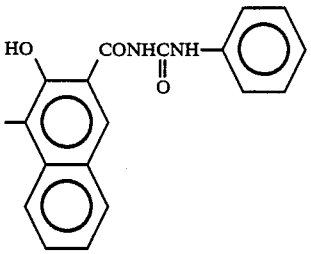
Exemplary pigment (2) - 54
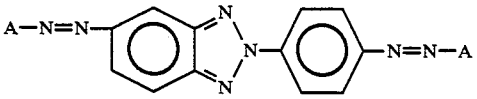
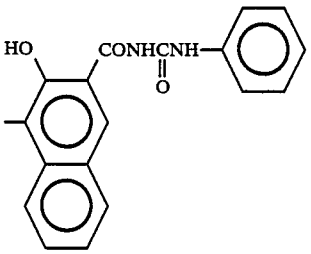
Exemplary pigment (2) - 55

-continued
| (Type of n = 2) | A |
|---|---|
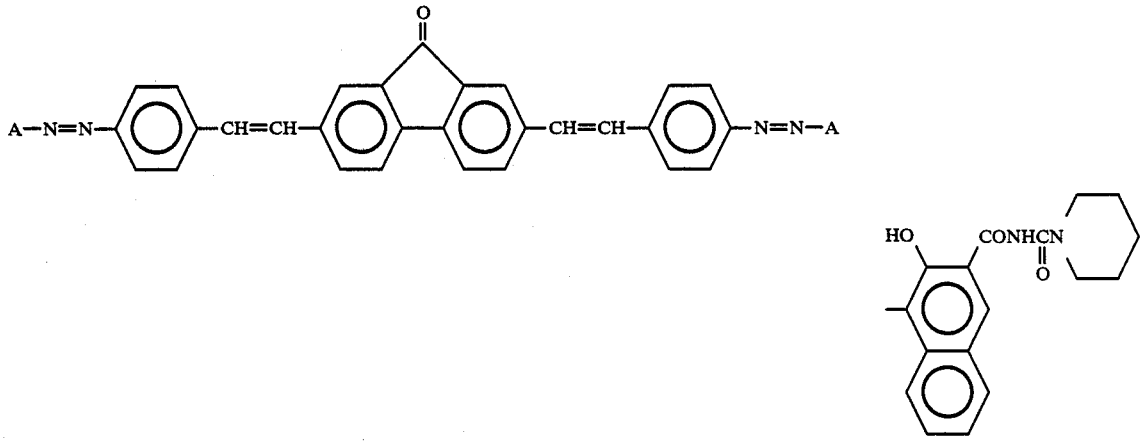
Exemplary pigment (2) - 56
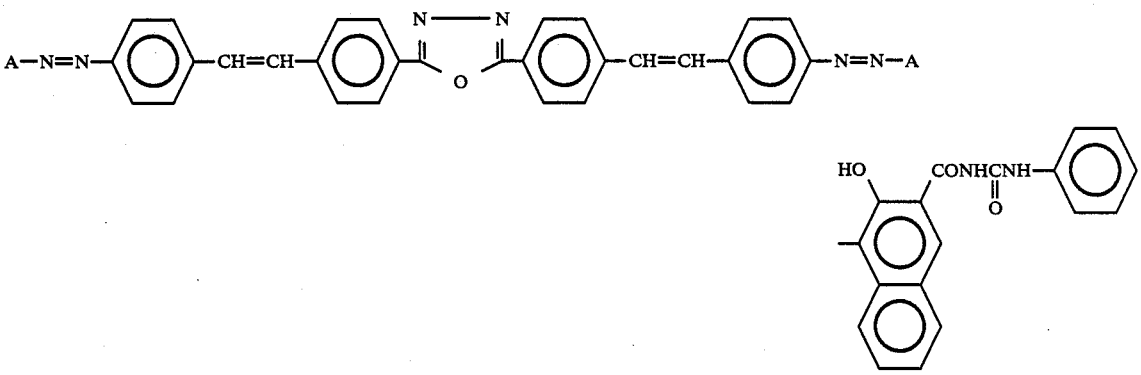
Exemplary pigment (2) - 57
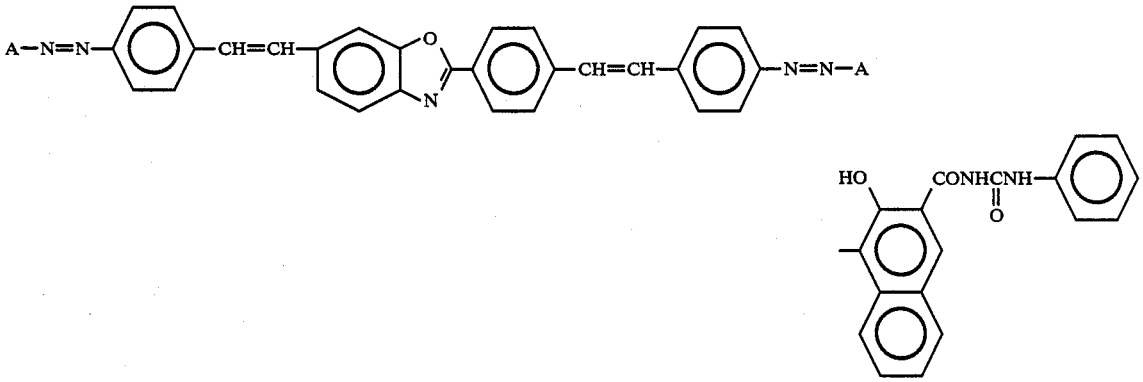
Exemplary pigment (2) - 58
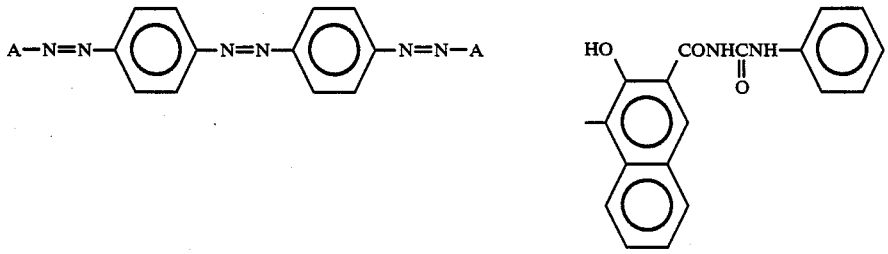
Exemplary pigment (2) - 59

-continued
| (Type of n = 2) | A |
|---|---|
| 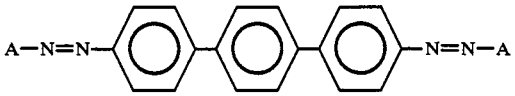 | 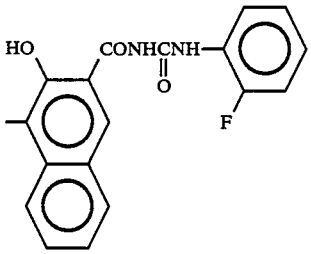 |
| Exemplary pigment (2) - 60 | |
| 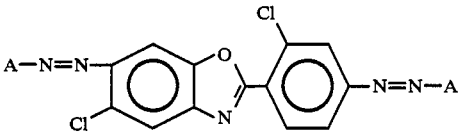 | 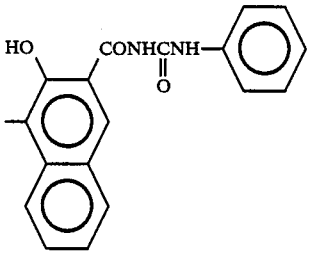 |
| Exemplary pigment (2) - 61<br>same as (2) - 60 | 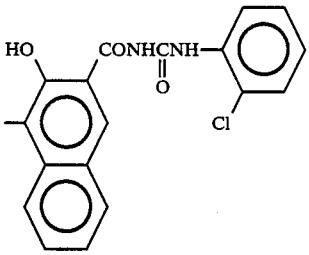 |
| Exemplary pigment (2) - 62<br>same as (2) - 60 | 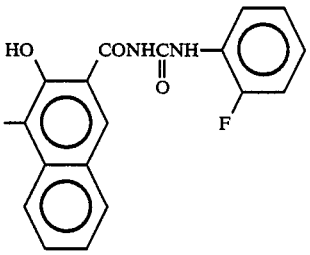 |
| Exemplary pigment (2) - 63<br>same as (2) - 60 | 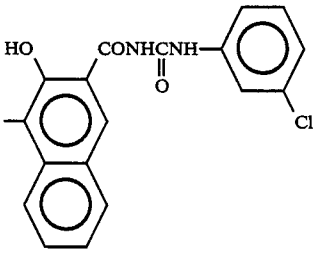 |
| Exemplary pigment (2) - 64 | |

-continued
| (Type of n = 2) | A |
|---|---|
| same as (2) - 60 | 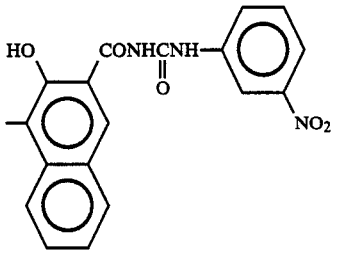 |
| Exemplary pigment (2) - 65<br>same as (2) - 60 | 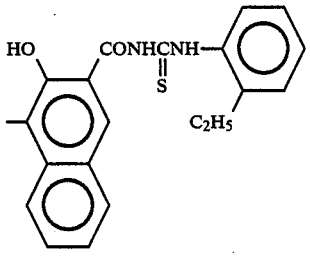 |
| Exemplary pigment (2) - 66 | 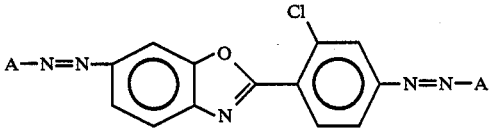 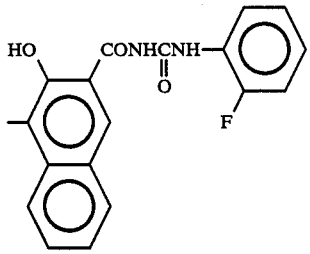 |
| Exemplary pigment (2) - 67<br>same as (2) - 66 | 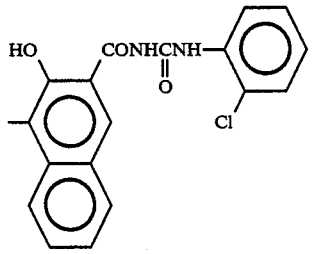 |
| Exemplary pigment (2) - 68<br>same as (2) - 66 | 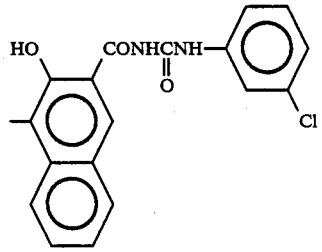 |
| Exemplary pigment (2) - 69 | |

-continued
| (Type of n = 2) | A |
|---|---|
| same as (2) - 66 | 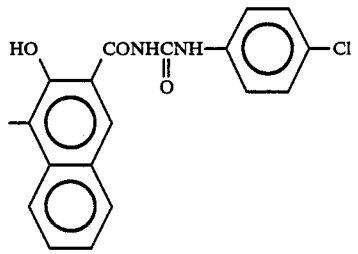 |
| Exemplary pigment (2) - 70<br>same as (2) - 66 | 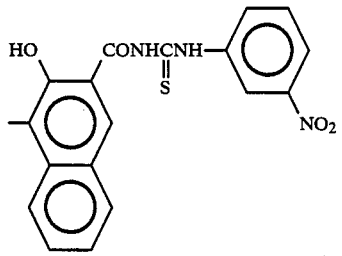 |
| Exemplary pigment (2) - 71<br> 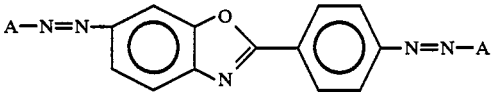 | 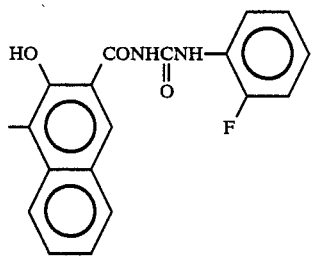 |
| Exemplary pigment (2) - 72<br>same as (2) - 71 | 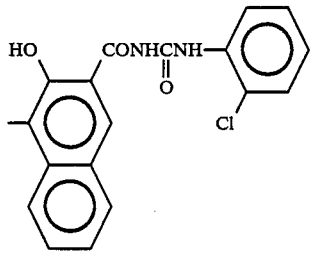 |
| Exemplary pigment (2) - 73<br>same as (2) - 71 | 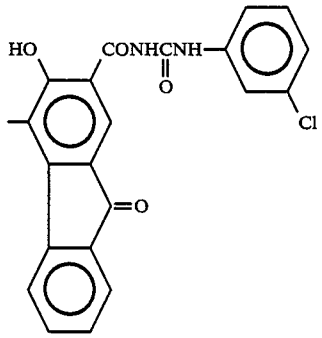 |
| Exemplary pigment (2) - 74 | |

-continued
| (Type of n = 2) | A |
|---|---|
| same as (2) - 71 | 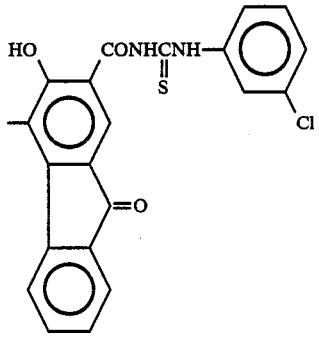 |
| Exemplary pigment (2) - 75<br>same as (2) - 71 | 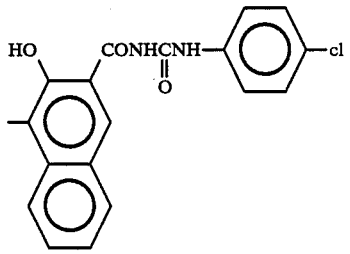 |
| Exemplary pigment (2) - 76<br>same as (2) - 71 | 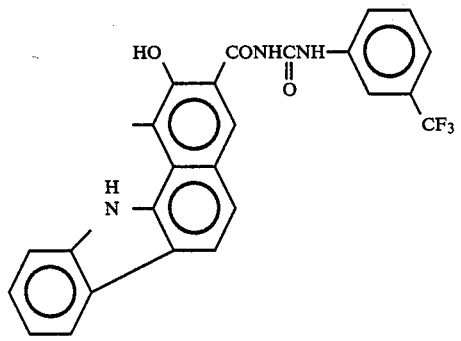 |
| Exemplary pigment (2) - 77<br>same as (2) - 71 | 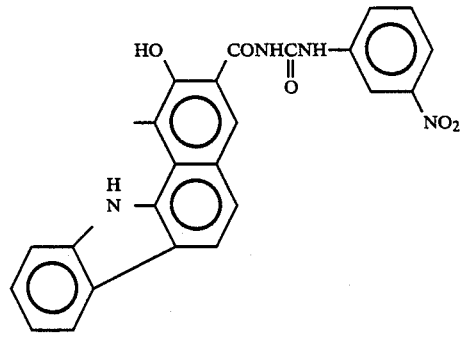 |
| Exemplary pigment (2) - 78 | |

-continued
| (Type of n = 2) | A |
|---|---|
| 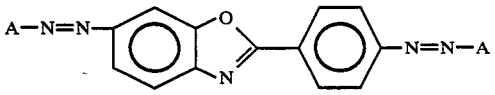 | 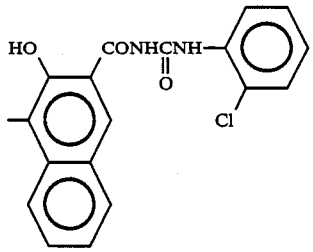 |
| Exemplary pigment (2) - 79<br>same as (2) - 78 | 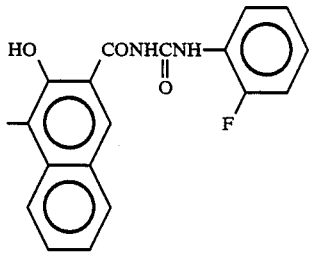 |
| Exemplary pigment (2) - 80<br>same as (2) - 78 | 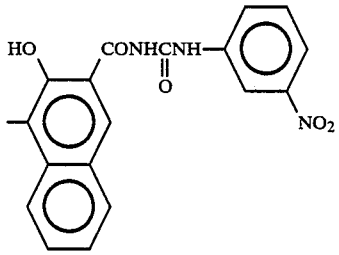 |
| Exemplary pigment (2) - 81<br>same as (2) - 78 | 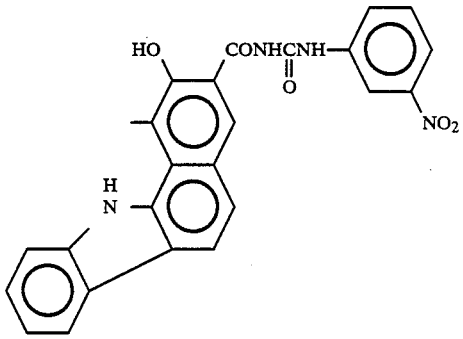 |
| Exemplary pigment (2) - 82<br>same as (2) - 78 | 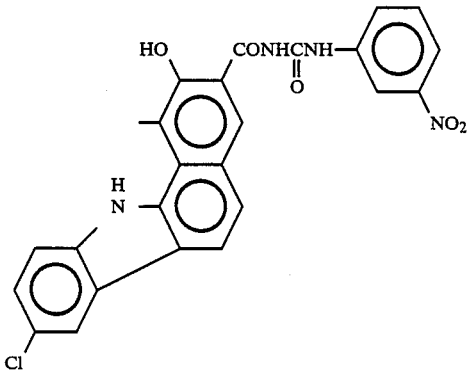 |

-continued
| (Type of n = 2) | A |
|---|---|
| Exemplary pigment (2) - 83<br>same as (2) - 78 | 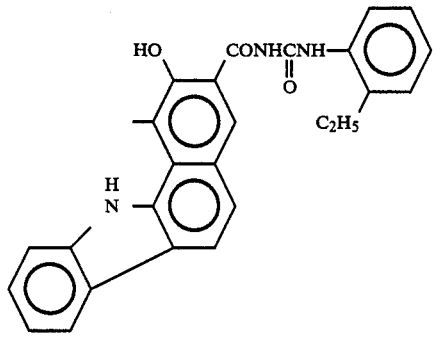 |
| Exemplary pigment (2) - 84 | 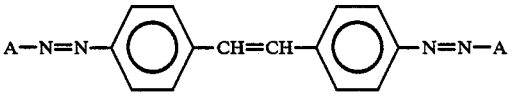 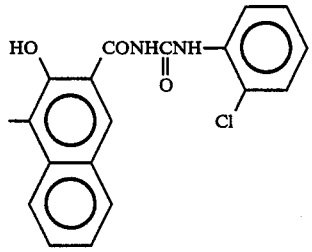 |
| Exemplary pigment (2) - 85<br>same as (2) - 84 | 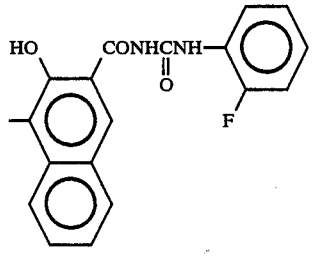 |
| Exemplary pigment (2) - 86<br>same as (2) - 84 | 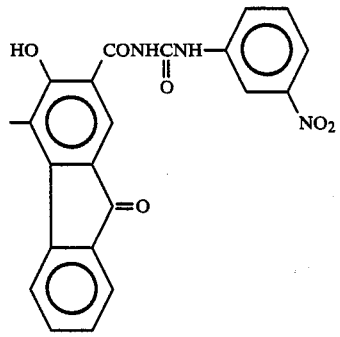 |
| Exemplary pigment (2) - 87 | |

-continued
| (Type of n = 2) | A |
|---|---|
| same as (2) - 84 | 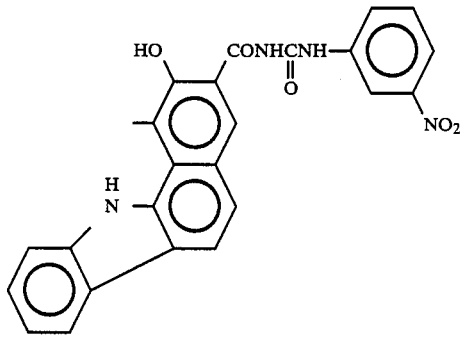 |
| Exemplary pigment (2) - 88<br>same as (2) - 84 | 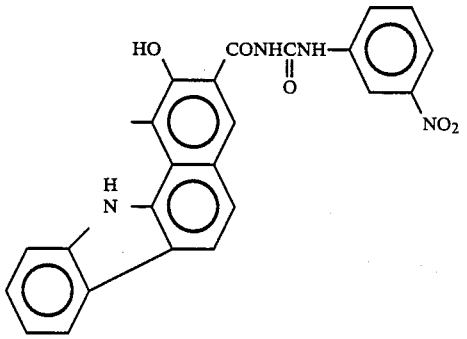 |
| Exemplary pigment (2) - 89<br>same as (2) - 84 | 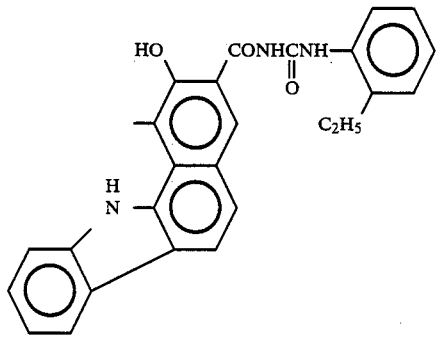 |
| Exemplary pigment (2) - 90 | 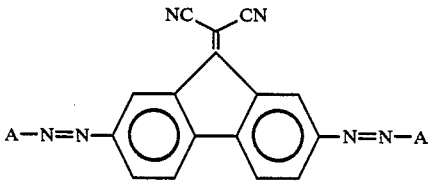 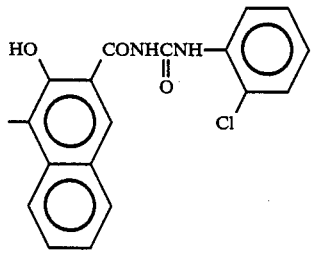 |
| Exemplary pigment (2) - 91 | |

-continued
| (Type of n = 2) | A |
|---|---|
| same as (2) - 90 | 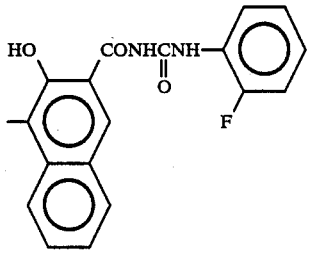 |
| Exemplary pigment (2) - 92<br>same as (2) - 90 | 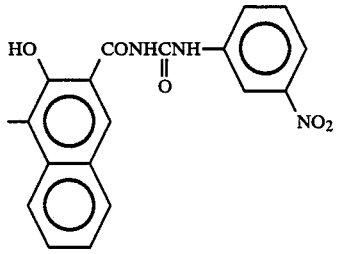 |
| Exemplary pigment (2) - 93<br>same as (2) - 90 | 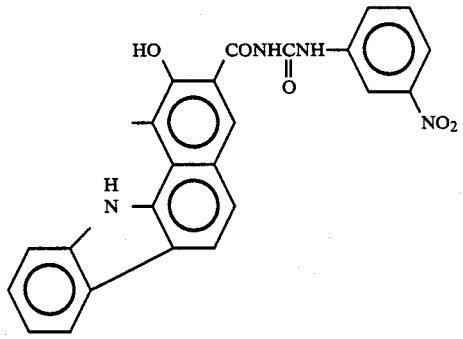 |
| Exemplary pigment (2) - 94<br>same as (2) - 90 | 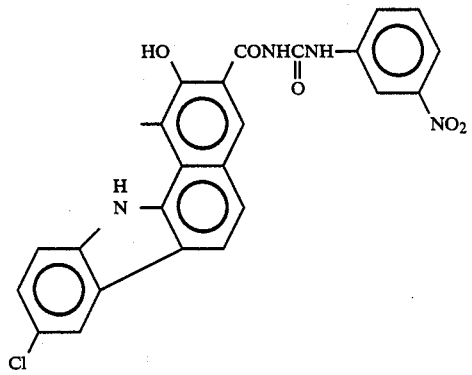 |
| Exemplary pigment (2) - 95 | |

-continued
| (Type of n = 2) | A |
|---|---|
| same as (2) - 90 | 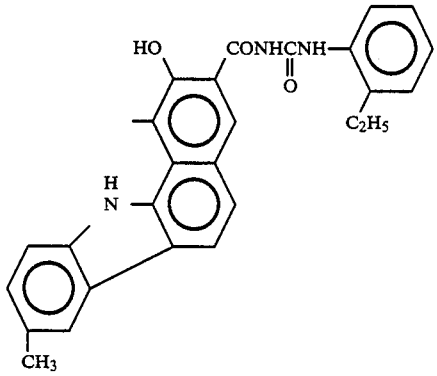 |
Exemplary pigment (2) - 96
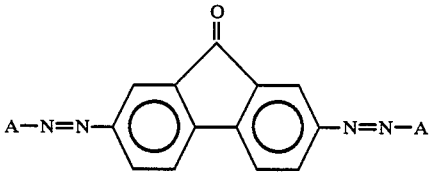
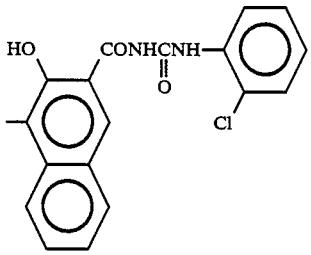
Exemplary pigment (2) - 97
same as (2) - 96
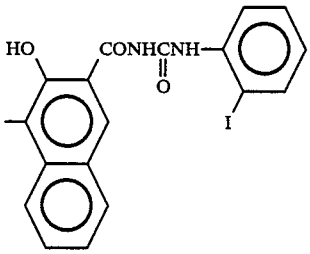
Exemplary pigment (2) - 98
same as (2) - 96
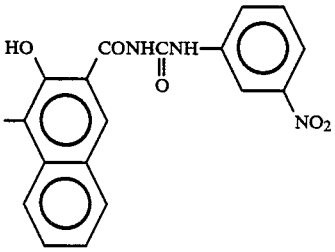
Exemplary pigment (2) - 99

-continued
| (Type of n = 2) | A |
|---|---|
| same as (2) - 96 | 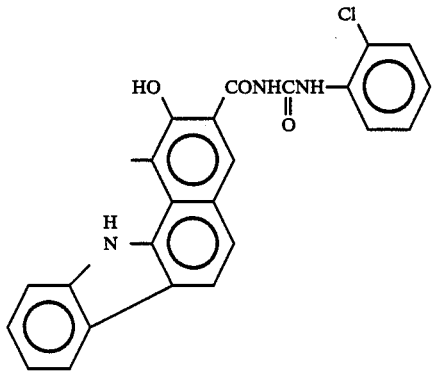 |
| Exemplary pigment (2) - 100<br>same as (2) - 96 | 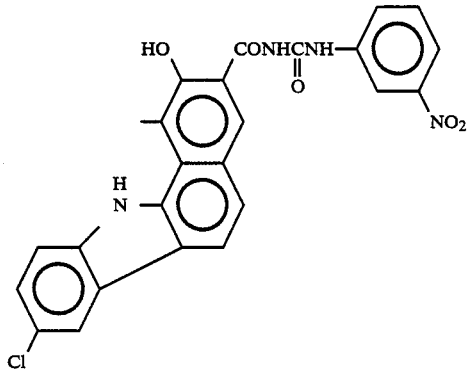 |
| Exemplary pigment (2) - 101<br>same as (2) - 96 | 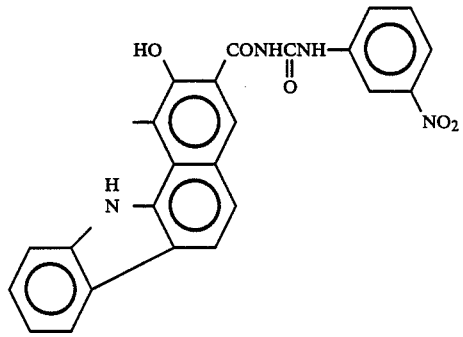 |
| Exemplary pigment (2) - 102 | 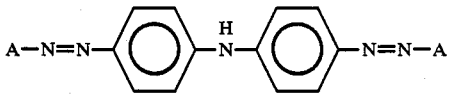 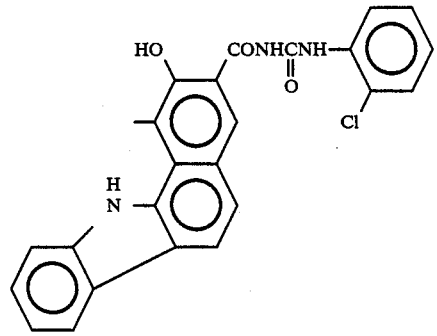 |
| Exemplary pigment (2) - 103 | |

-continued
| (Type of n = 2) | A |
|---|---|
| same as (2) - 102 | 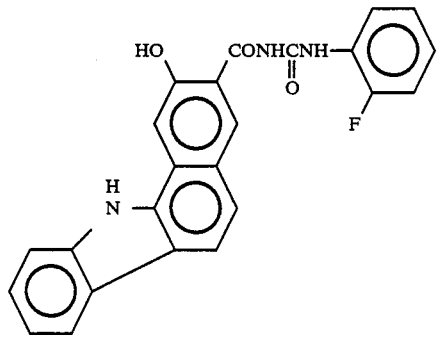 |
| Exemplary pigment (2) - 104<br>same as (2) - 102 | 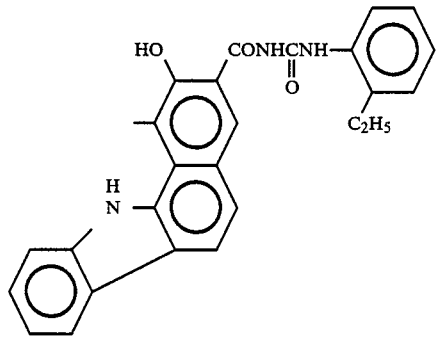 |
| Exemplary pigment (2) - 105<br>same as (2) - 102 | 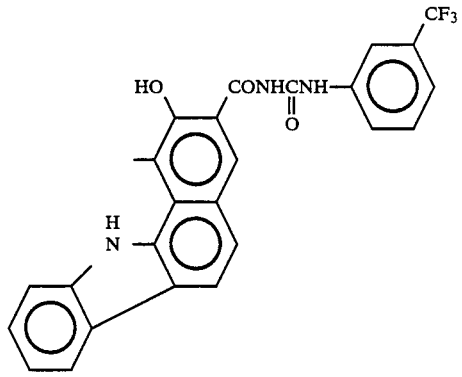 |
| Exemplary pigment (2) - 106<br>same as (2) - 102 | 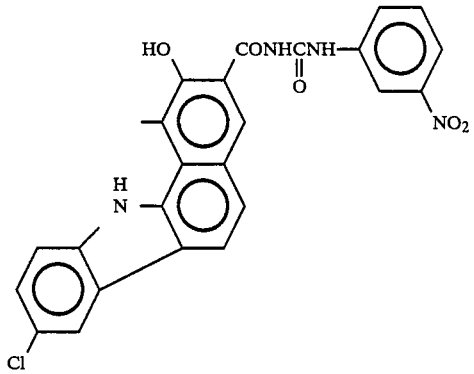 |
| Exemplary pigment (2) - 107 | |

-continued
| (Type of n = 2) | A |
|---|---|
| same as (2) - 102 | 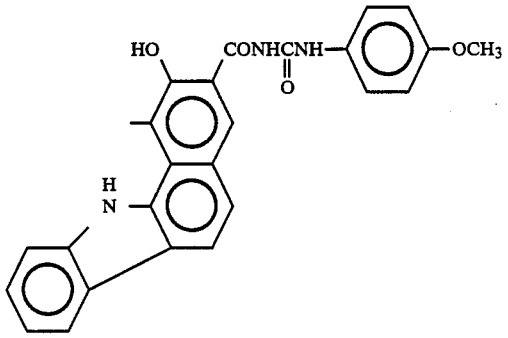 |
| Exemplary pigment (2) - 108 | 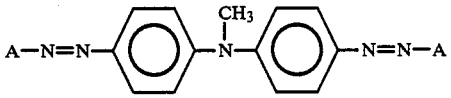 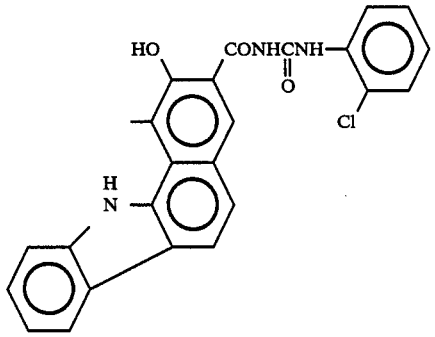 |
| Exemplary pigment (2) - 109<br>same as (2) -108 | 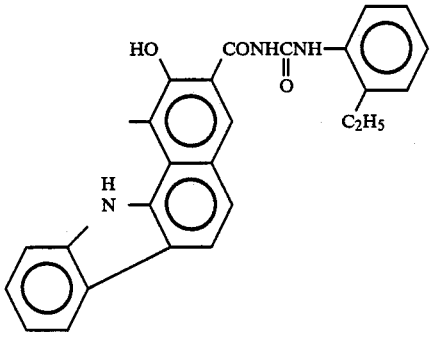 |
| Exemplary pigment (2) - 110<br>same as (2) - 108 | 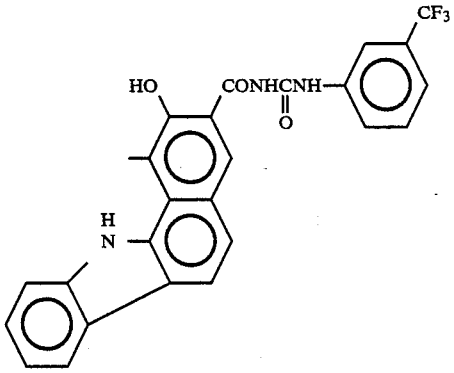 |
| Exemplary pigment (2) - 111 | |

-continued
| (Type of n = 2) | A |
|---|---|
| same as (2) - 108 | 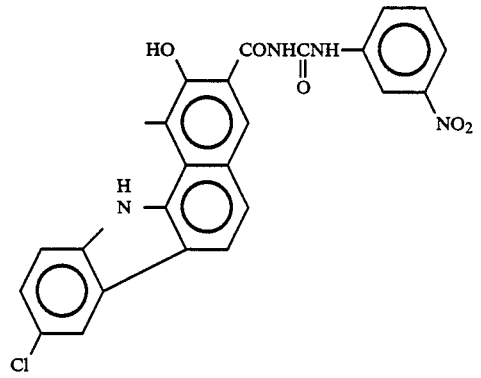 |
Exemplary pigment (2) - 112
same as (2) - 108
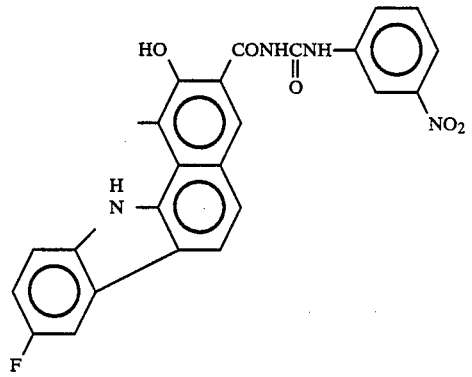
Exemplary pigment (2) - 113
same as (2) -108
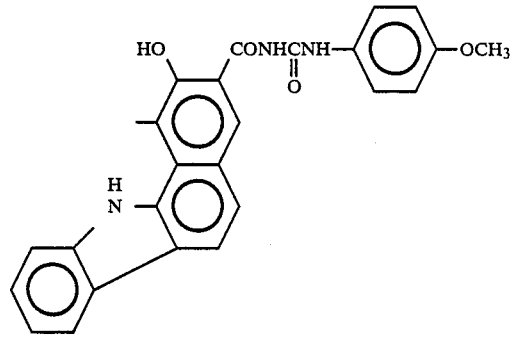
Exemplary pigment (2) - 114
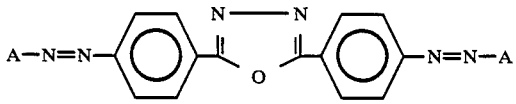
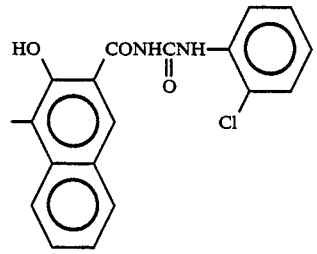
Exemplary pigment (2) - 115

-continued
| (Type of n = 2) | A |
|---|---|
| same as (2) - 114 | 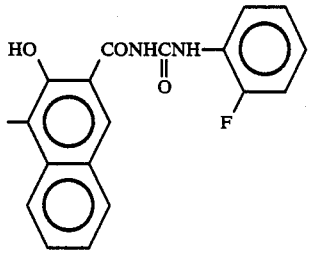 |
| Exemplary pigment (2) - 116<br>same as (2) - 114 | 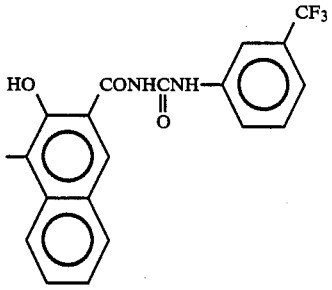 |
| Exemplary pigment (2) - 117<br>same as (2) - 114 | 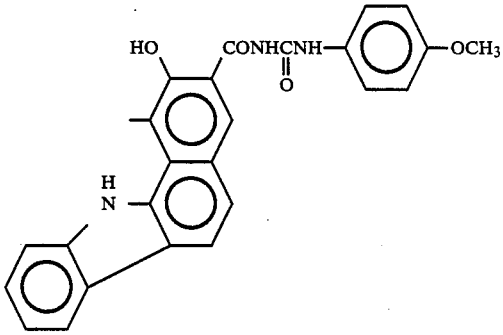 |
| Exemplary pigment (2) - 118<br>same as (2) - 114 | 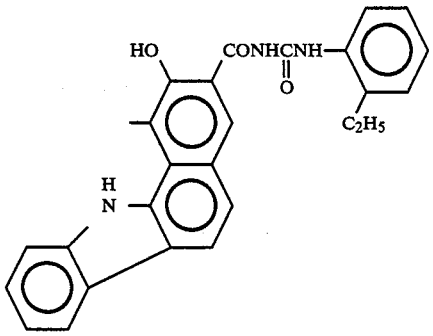 |
| Exemplary pigment (2) - 119 | |

-continued
| (Type of n = 2) | A |
|---|---|
| same as (2) -114 | 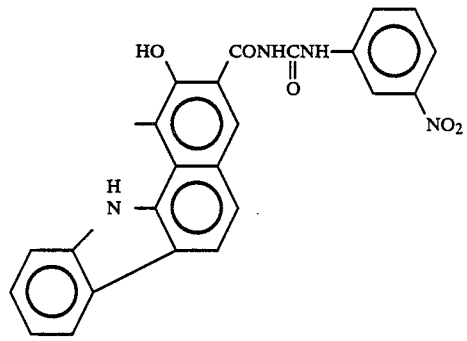 |
The disazo pigments listed below are examples having an organic residue from the organic residues represented by the formula (I) and an organic residue corresponding to the above formula (III) different from said selected organic residue.
Exemplary pigment (2)-120
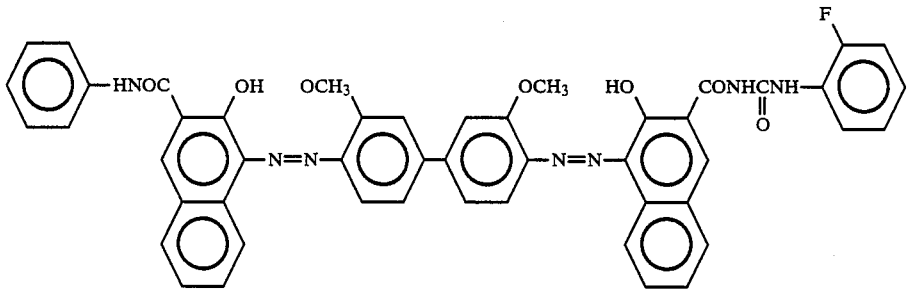
Exemplary pigment (2)-121
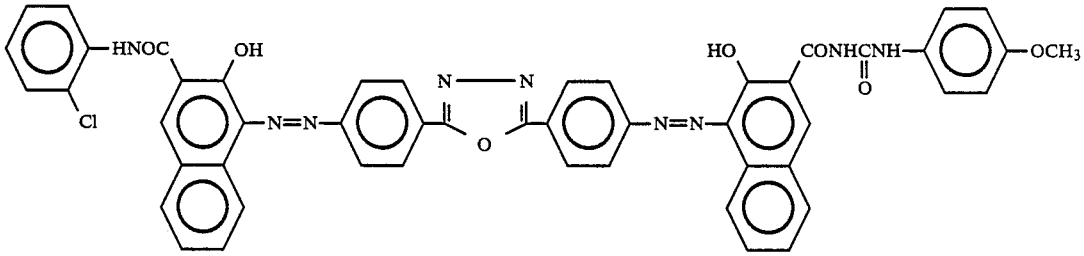
Exemplary pigment (2)-122
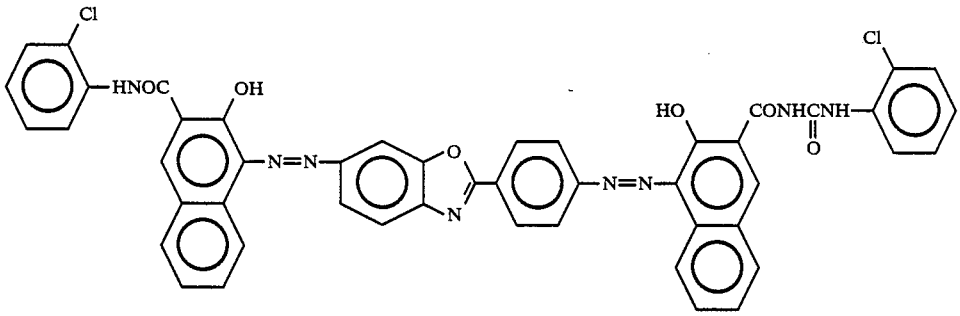
Exemplary pigment (2)-123

-continued
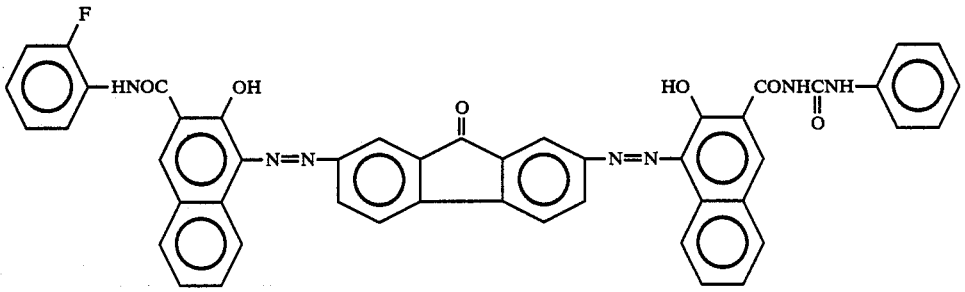
Exemplary pigment (2)-124
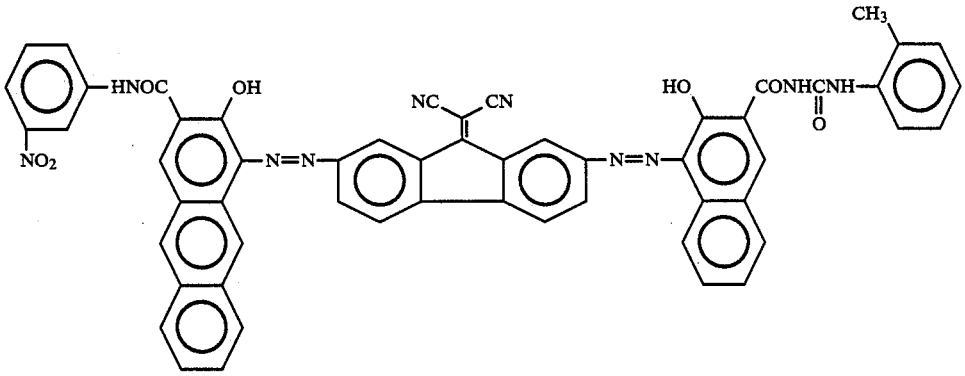
Exemplary pigment (2)-125
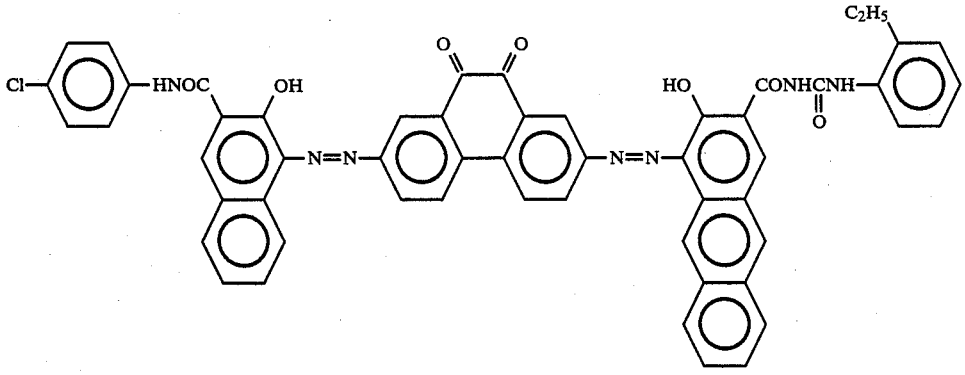
Exemplary pigment (2)-126

-continued
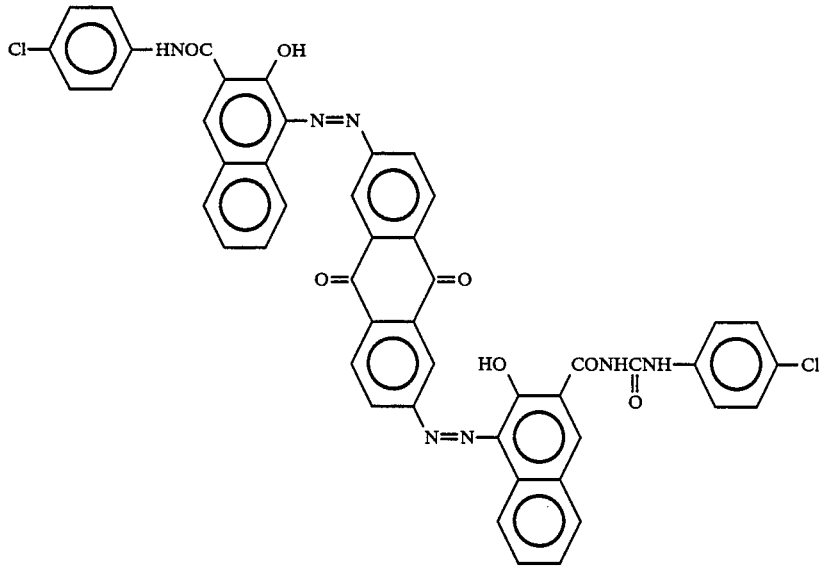
Exemplary pigment (2)-127
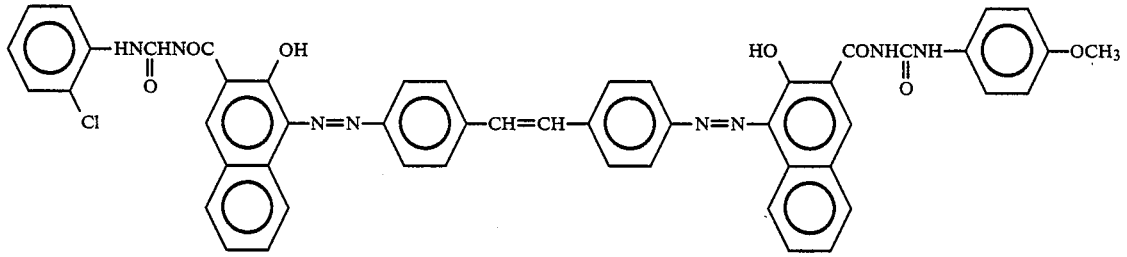
Exemplary pigment (2)-128
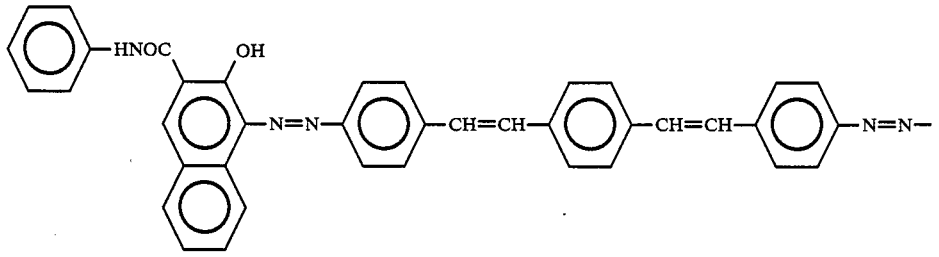
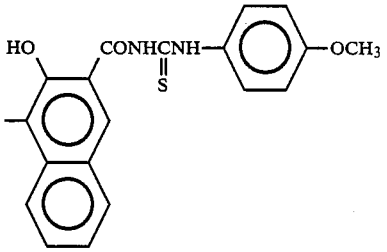
Exemplary pigment (2)-129

-continued
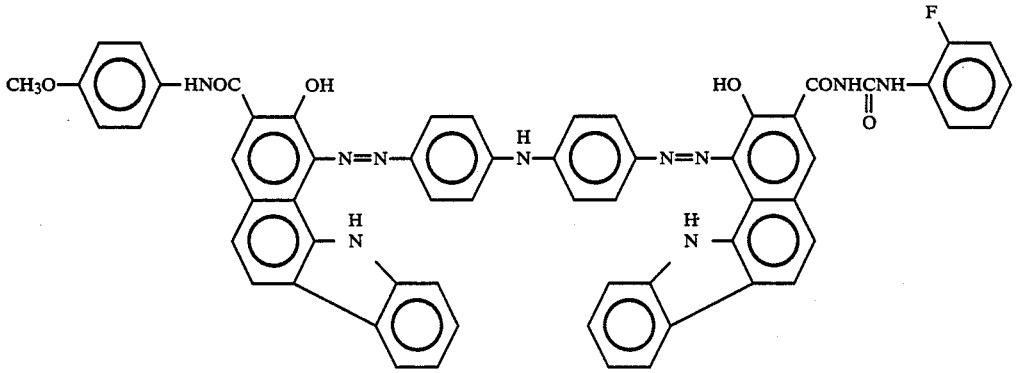
Exemplary pigment (2)-130
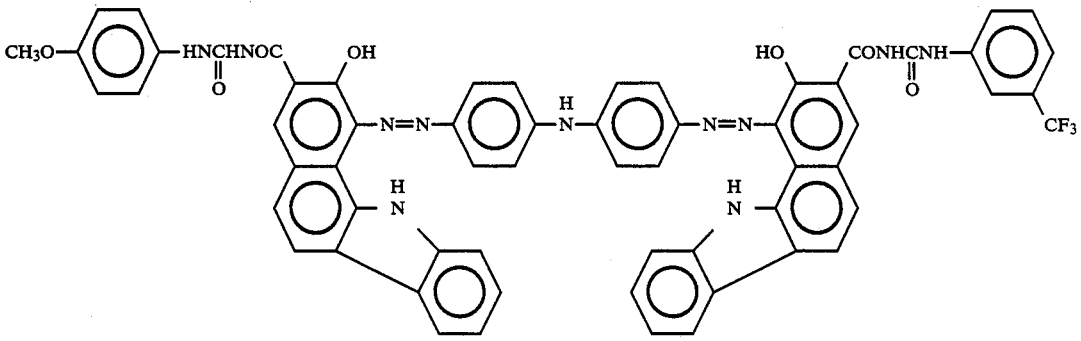
Exemplary pigment (2)-131
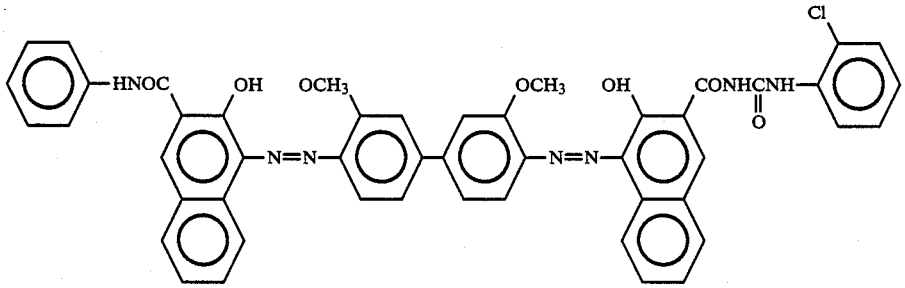
Exemplary pigment (2)-132
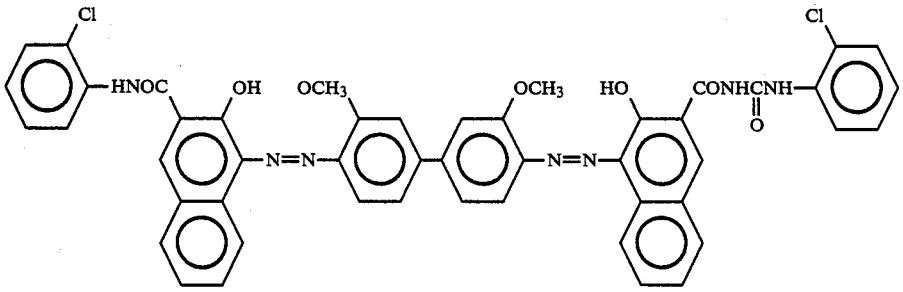
Exemplary pigment (2)-133

-continued
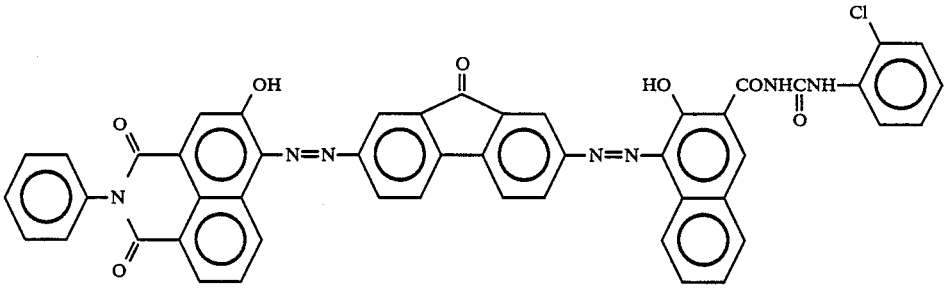
Exemplary pigment (2)-134
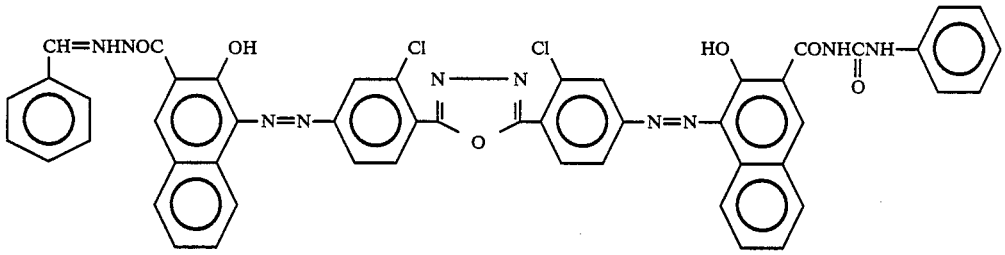

| (Type of n = 3) | A |
|---|---|
| Exemplary pigment (3) - 1 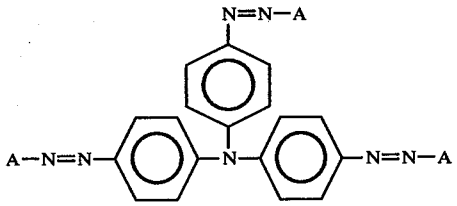 | 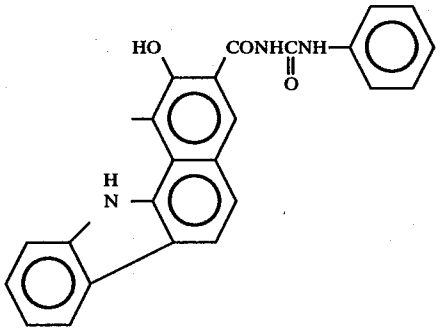 |
| Exemplary pigment (3) - 2 same as (3) - 1 | 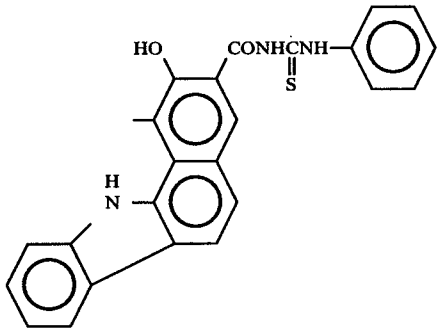 |
| Exemplary pigment (3) - 3 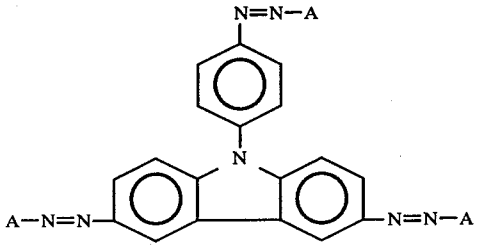 | 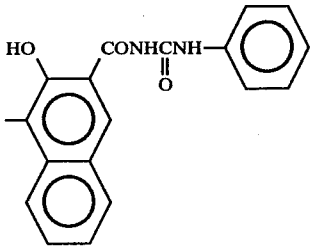 |
| Exemplary pigment (3) - 4 | |

-continued
| (Type of n = 3) | A |
|---|---|
| 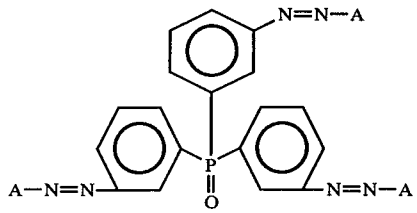 | 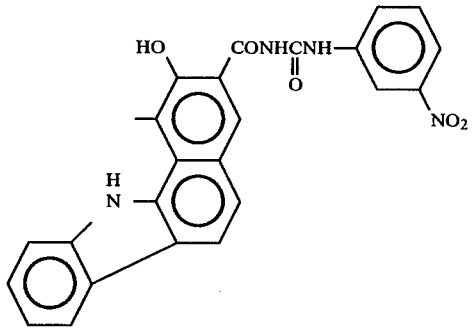 |
| Exemplary pigment (3) - 5 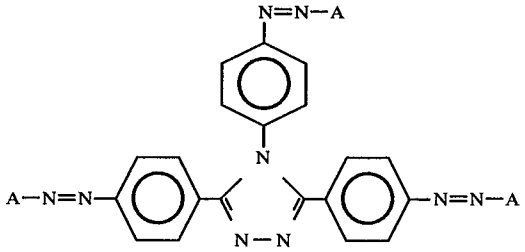 | 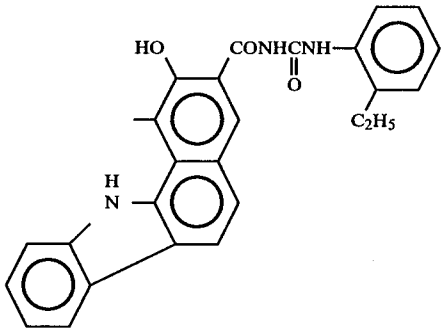 |
| Exemplary pigment (3) - 6 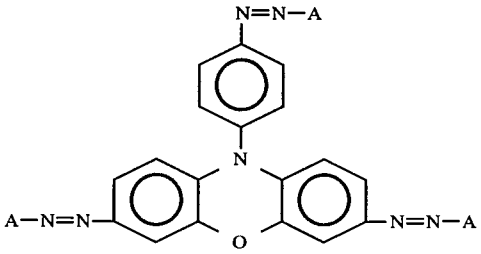 | 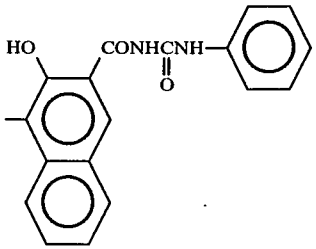 |
| Exemplary pigment (3) - 7 | |

-continued
| (Type of n = 3) | A |
|---|---|
| 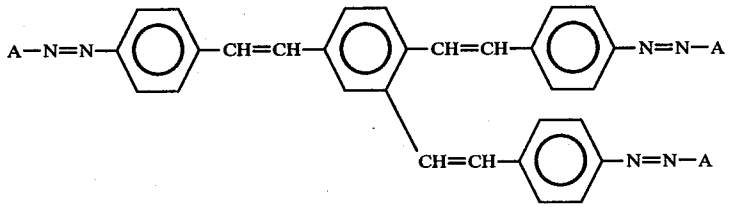 | 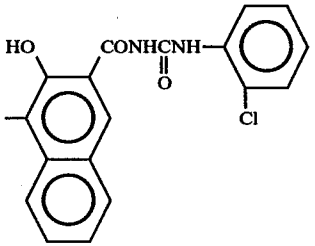 |
Exemplary pigment (3) - 8
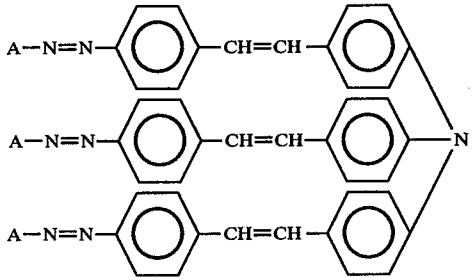
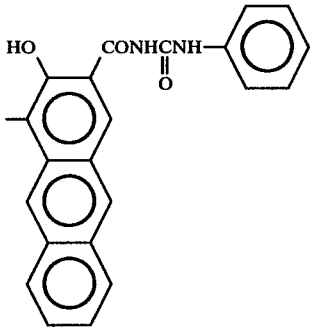
Exemplary pigment (3) - 9
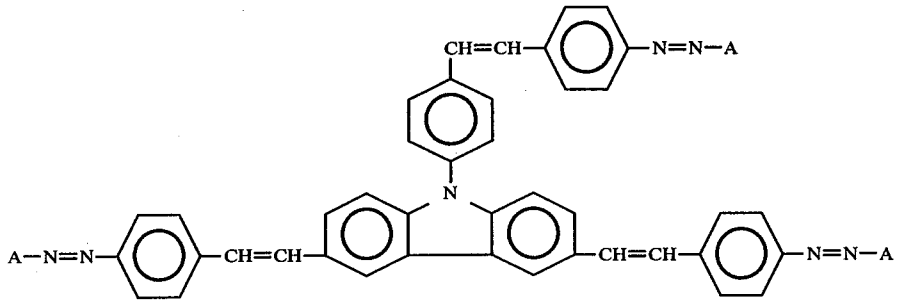
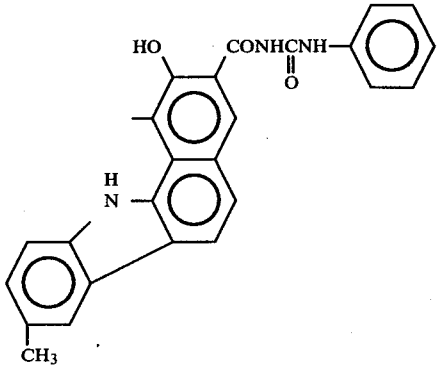

-continued
| (Type of n = 3) | A |
|---|---|
| Exemplary pigment (3) - 10 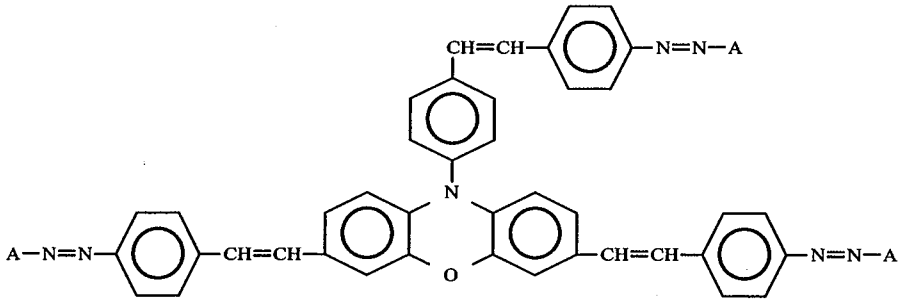 | 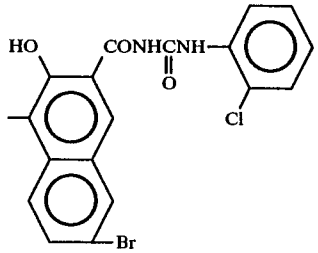 |
| Exemplary pigment (3) - 11 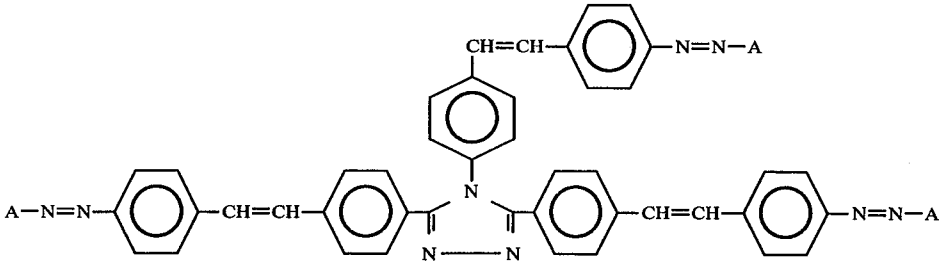 | 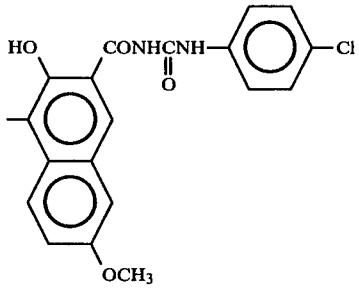 |
| Exemplary pigment (3) - 12 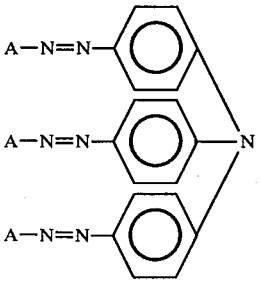 | 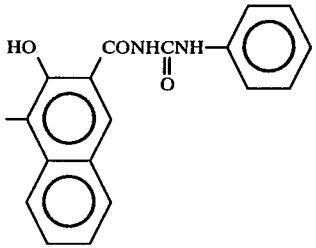 |
| Exemplary pigment (3) - 13 | |

-continued
| (Type of n = 3) | A |
|---|---|
| same as (3) - 12 | 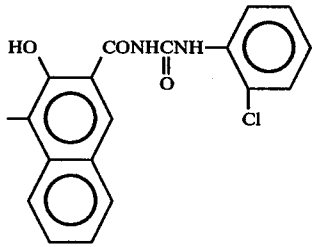 |
| Exemplary pigment (3) - 14<br>same (3) - 12 | 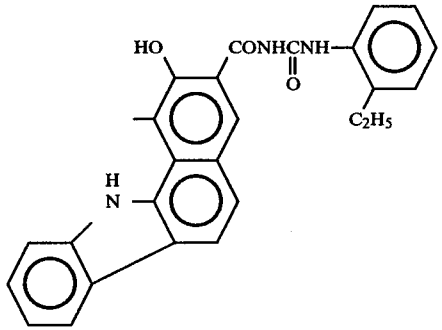 |
| Examplary pigment (3) - 15<br>same as (3) - 12 | 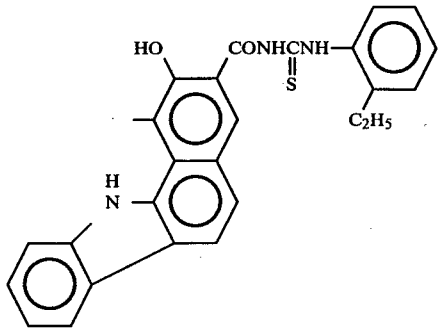 |
| Exemplary pigment (3) - 16 | |

-continued
| (Type of n = 3) | A |
|---|---|
| same as (3) - 12 | 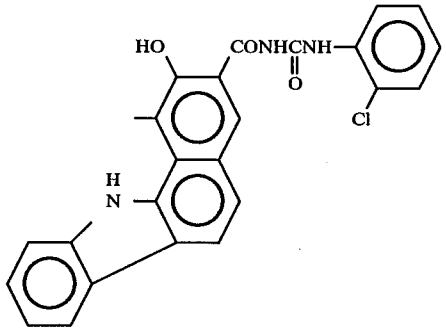 |
| Exemplary pigment (3) - 17 | |
| same as (3) - 12 | 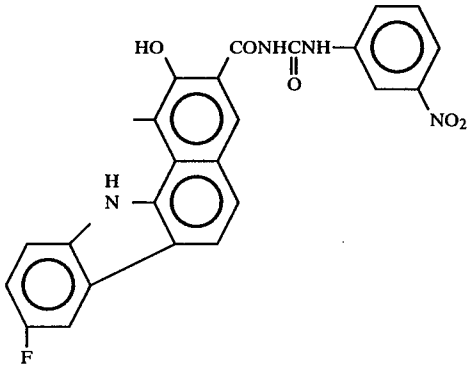 |
| Exemplary pigment (3) - 18 | |

-continued
| (Type of n = 3) | A |
|---|---|
| same as (3) - 12 | 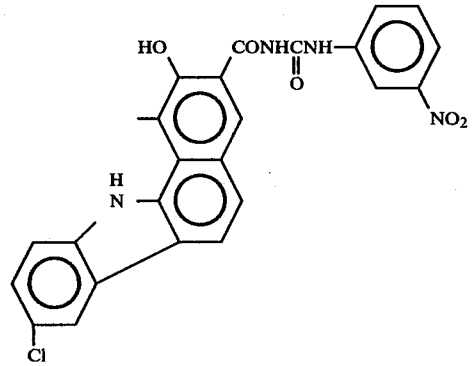 |
| Exemplary pigment (3) - 19<br>same as (3) - 12 | 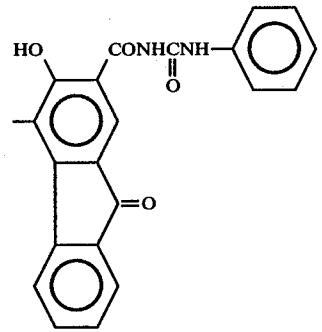 |

The following trisazo pigments are examples having an organic residue from the organic residues represented by the formula (I) and an organic residue corresponding to the above formula (III) different from said selected organic residue.
Exemplary pigment (3)-20
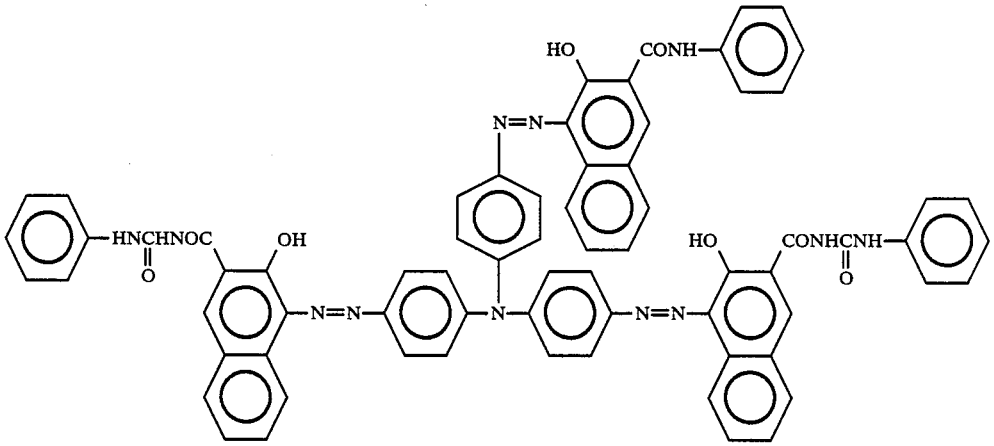
Exemplary pigment (3)-21
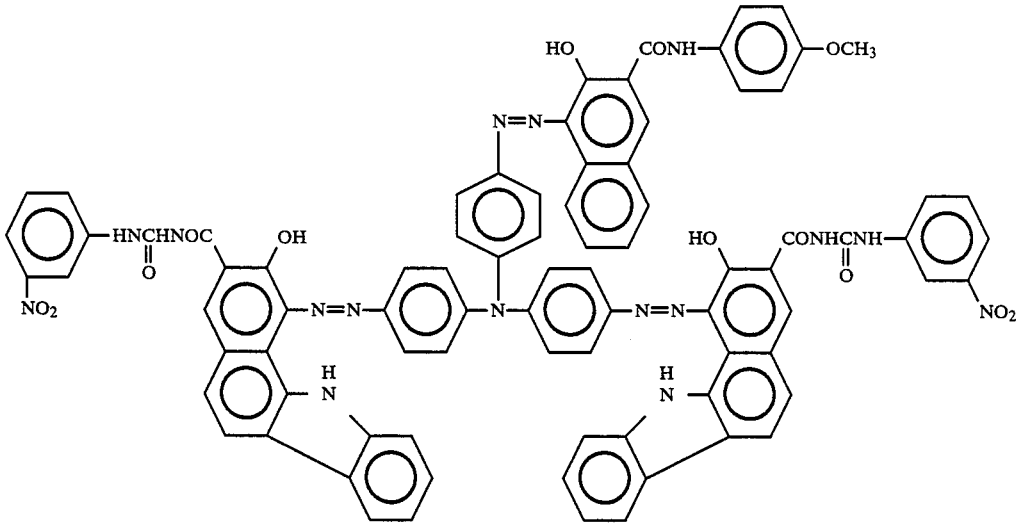
Exemplary pigment (3)-22

-continued
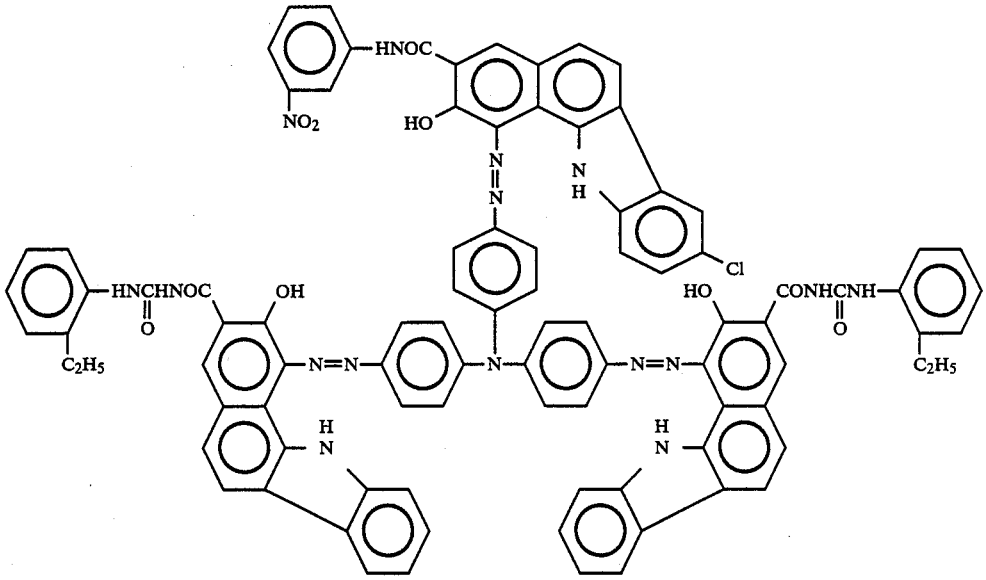

| (Type of n = 4) | A |
|---|---|
| Exemplary pigment (4) - 1 | 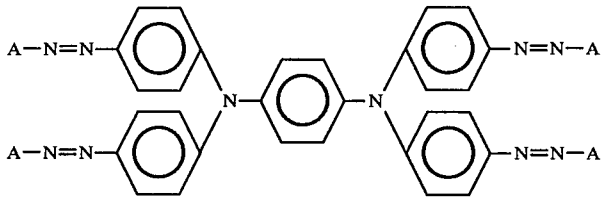 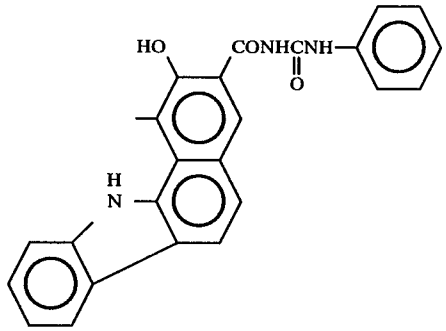 |
| Exemplary pigment (4) - 2 | 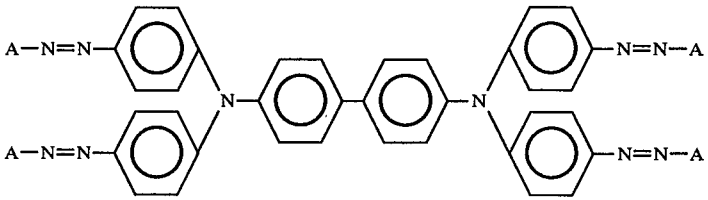 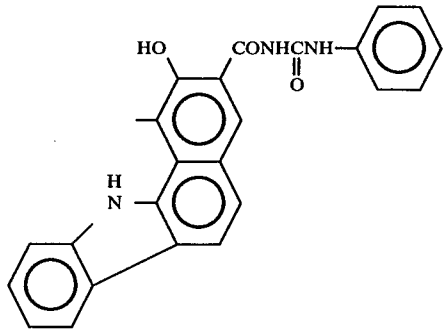 |
| Exemplary pigment (4) - 3 | |

-continued
| (Type of n = 4) | A |
|---|---|
| 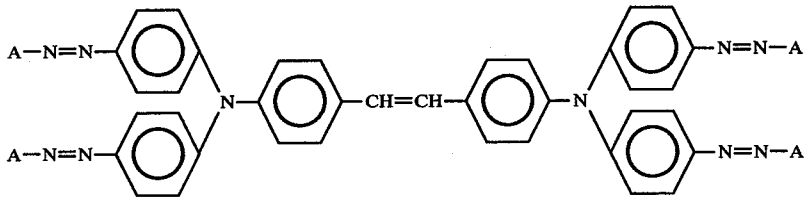 | 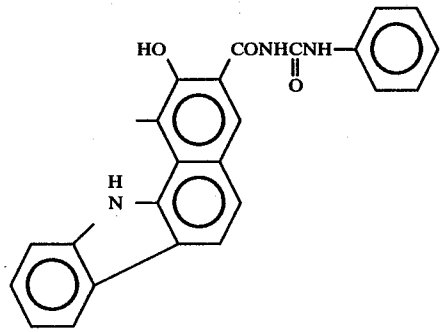 |
| Exemplary pigment (4) - 4 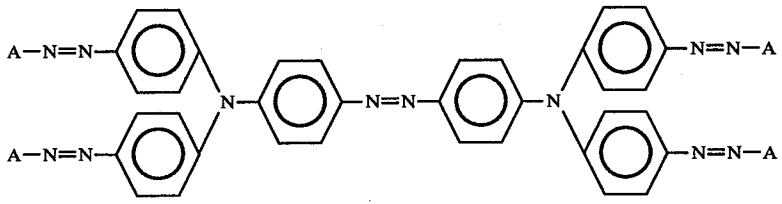 | 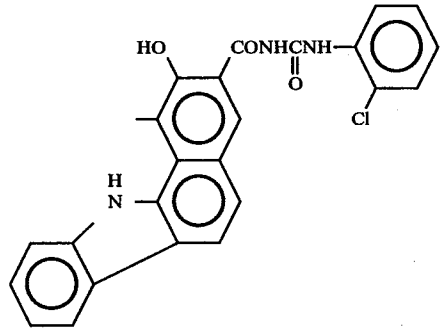 |

The following tetrakisazo pigments are examples having an organic residue from the organic residues represented by the formula (I) and an organic residue corresponding to the above formula (III) different from said selected organic residue.

Exemplary pigment (4)-5

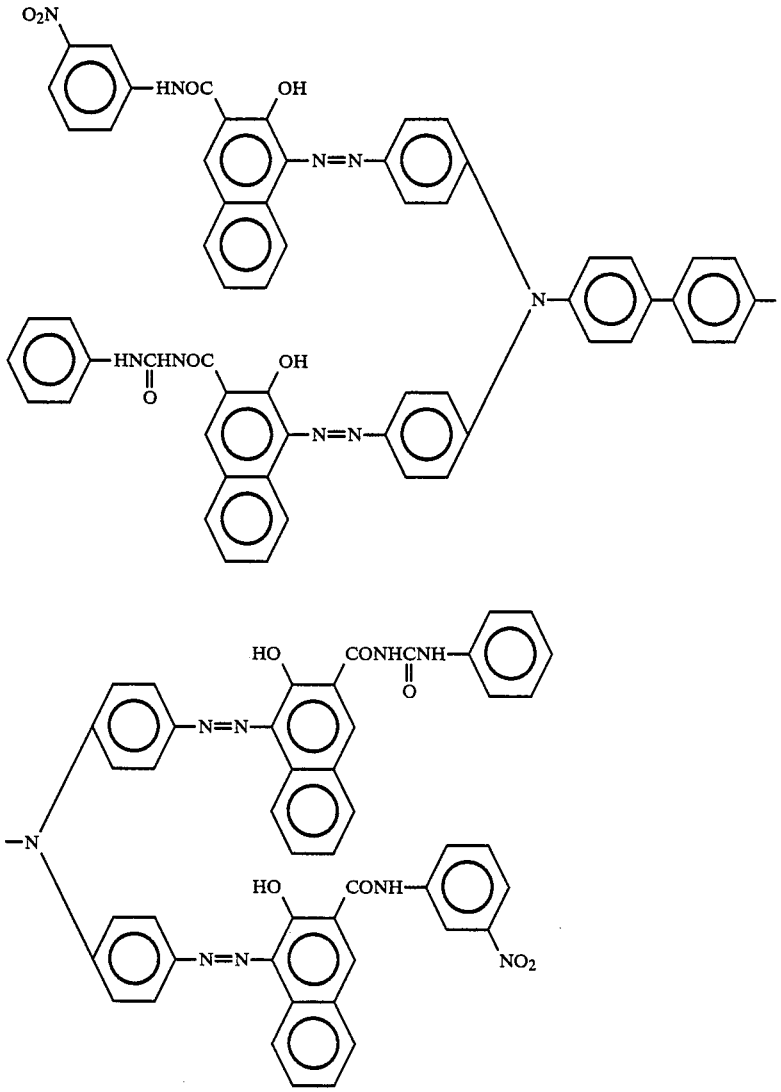

The azo pigment to be used in the present invention can be synthesized by subjecting a coupler component represented by the formula:

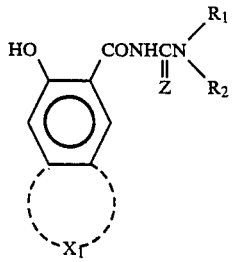

(XVI)

wherein $X_1$, $R_1$, $R_2$ and Z have the same meanings as in the formula (I), and a compound having a diazonium salt structure to coupling reaction in the presence of an alkali.

Further, the above coupler component can be synthesized by subjecting a carboxylic acid represented by the formula:

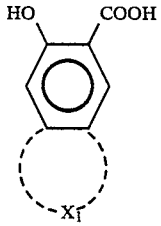

(XVII)

wherein $X_1$ has the same meaning as above, and a urea represented by the formula:

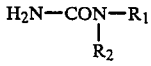

(XVIII)

wherein $R_1$ and $R_2$ have the same meanings as above, to condensation by heating at 80° to 200° C. in an aromatic solvent such as benzene, toluene, xylene, cholorobenzene, o-dichlorobenzene, etc. in the presence of phosphorus trichloride, or by heating an acid chloride represented by the formula:

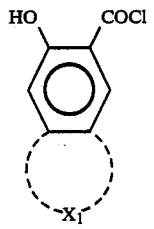

(XIX)

wherein $X_1$ has the same meaning as above and the above urea in the above aromatic solvent.

By use of the coupler component thus obtained, an amino compound represented by the formula Ar $(NH_2)_n$ (XX) (wherein Ar and n have the same meanings as in the formula (II)) is diazotized in a conventional manner, and subjected to aqueous coupling reaction in the presence of an alkali, or the diazonium salt of the above amino compound is once isolated in the form of a salt such as borofluoride or zinc chloride double salt, etc., and then subjected to organic solvent coupling reaction in an organic solvent such as N,N-dimethylformamide, N,N-dimethylacetamide, dimethylsulfoxide, etc. in the presence of sodium acetate, pyridine, trimethylamine, triethylamine, etc., whereby the azo pigment of the present invention can be produced.

Also, the azo pigment to be used in the present invention (in the case of the type of n=2, 3, 4) may contain one or more of the organic residues represented by the formula (I) within the same molecule, and it may be prepared by diazotizing an amino compound represented by the formula:

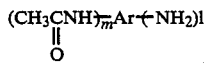

(XXI)

wherein

Ar is the same as defined above, m is an integer of 1, 2 or 3, l is an integer of 3, 2, or 1, in a conventional manner, subjecting the diazonium salt formed and the coupler component represented by the above formula (XVI) to coupling in the presence of an alkali, then hydrolyzing the product with a mineral acid such as hydrochloric acid to obtain a reaction product corresponding to the formula:

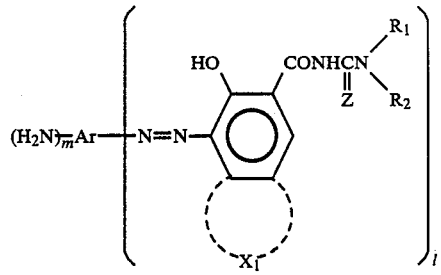

and diazotizing again the product in a conventional manner, followed by successive coupling reaction with a coupler component having another phenolic OH group; or on the other hand, it may be prepared by adding the diazonium salt of the amino compound represented by the formula (XX) obtained in a conventional manner into a mixed coupler solution containing at least one of the coupler components represented by the formula (XVI) and carrying out coupling reaction in the presence of an alkali; or also it can be prepared by carrying out primary coupling with one kind of the coupler components represented by the formula (XVI) in the presence of an alkali, and then adding successively an aqueous alkali-existing solution of another kind of coupler component to complete the coupling reaction.

In the following, representative synthesis examples are shown.

Synthesis example 1 (Exemplary pigment (2) - 1)

Into a 500 ml beaker were charged 80 ml of water and 25.3 ml (0.29 mol) of conc. hydrochloric acid, and to the resultant mixture, under cooling in ice-water bath, was added 7.1 g (0.029 mol) of o-dianisidine, and the liquid temperature was made 3° C. under stirring.

Next, a solution of 4.2 g (0.061 mol) of sodium nitrite dissolved in 7 ml of water was added dropwise over 10 minutes while controlling the liquid temperature at 5° C. or lower, and after completion of the dropwise addition, the mixture was further stirred at the same temperature for 30 minutes. The reaction mixture was added with carbon and filtered to obtain a tetrazotized solution.

Next, into a 2-liter beaker was charged 700 ml of dimethylformamide, added 53.0 g (0.53 mol) of triethylamine and then 18.7 g (0.061 mol) of 2-hydroxynaphthalene-3-carboxylic acid-N'-phenylureido to be dissolved therein.

The coupler solution was cooled to 5° C. and, while controlling the liquid temperature to 5° to 10° C., the tetrazotized solution as described above was added dropwise over 30 minutes, and then stirred for 2 hours, followed further by leaving to stand at room temperature overnight. The reaction mixture was filtered, washed with water and filtered to obtain 24.7 g of water paste of a crude pigment as calculated on solids.

Next, by use of 400 ml of N,N-dimethylformamide, stirring filtration was repeated 4 times at room temperature.

Thereafter, after stirring filtration was repeated twice each with 400 ml of methyl ethyl ketone, the product was dried at room temperature under reduced pressure to obtain 22.2 g of a purified pigment.

Yield: 87.0%, m.p.>250° C.

| Elemental analysis: | Calcd. (%) | Found (%) |
|---|---|---|
| C | 68.3 | 68.1 |
| H | 4.37 | 4.34 |
| N | 12.8 | 12.90 |

Synthesis example 2 (mixture of Exemplary pigments (2)-1, (2)-131 and (2)-132)

Into a 2-liter beaker was placed 700 ml of dimethylformamide, added 53.0 g (0.53 mol) of triethylamine, and then added 9.35 g (0.031 mol) of 2-hydroxynaphthalene-3-carboxylic acid-N'-phenylureido and 10.56 g (0.031 mol) of 2-hydroxynaphthalene-3-carboxylic acid-N'-(o-chlorophenyl)ureido to be dissolved therein.

The mixed coupler solution was cooled to 5° C. and, while controlling the liquid temperature to 5° to 10° C., the tetrazotized solution obtained in the same manner as in Synthesis example 1 was added dropwise over 30 minutes, and the mixture was then stirred for 2 hours, followed further by leaving to stand at room temperature overnight. The reaction mixture was filtered, then washed with water and filtered to obtain 25.0 g of a water paste of a crude pigment as calculated on solids. Following subsequently the same procedure as in Synthesis example 1, 22.0 g of a purified pigment was obtained. m.p.>250° C.

The present inventors have studied intensively concerning the above problems, and consequently found that the above problems can be solved by incorporating an azo pigment containing the organic residue represented by the above formula (I).

While the reason has not yet been clarified, the present inventors have estimated it as follows. That is, by increasing the functional groups having hydrogen bonding ability at specific position within the pigment molecule, changes will occur in alignment, arrangement between the pigment molecules to improve either one or both of generation efficiency or conveyability of carriers, resulting in accomplishment of higher sensitization simultaneously with enhancement of resistance to oxidative substances such as ozone generated in the copying machine, whereby stable potential can be retained even when used repeatedly.

By accomplishment of higher sensitization, application for high speed copying, laser beam printer, LED printer, liquid crystal printer, etc. has become possible, and further since stable potential can be ensured, beautiful images which are also stable as the image can be obtained.

The coating having the azo pigment as described above exhibits photoconductivity and therefore can be used as the photosensitive layer of the electrophotographic photosensitive member as described below.

More specifically, in a specific example of the present invention, the electrophotographic photosensitive member can be prepared by forming a coating of the azo pigment as described above dispersed in a suitable binder on an electroconductive support.

According to a preferable example of the present invention, the photoconductive coating as described above can be applied as the charge generation layer in the electrophotographic photosensitive member in which the photosensitive layer of the electrophotographic photosensitive member is separated into the functions of the charge generation layer and the charge transport layer.

The charge generation layer, in order to obtain sufficient light absorbance, should desirably contain as much azo pigment exhibiting photoconductivity as described above as possible, and also for the charge carriers generated to be transported efficiently to the interface with the charge transport layer or the electroconductive support, should be desirably made a thin film layer having a film thickness of, for example, 5 μm or less, preferably 0.01 to 1 μm.

This is due to the fact that most of the incident light quantity is absorbed in the charge generation to form much charge carriers, and further that the charge carriers generated are required to be injected into the charge generation layer without deactivation by recombination or trapping.

The charge generation layer can be formed by dispersing the azo dye as described above in a suitable binder and coating the dispersion onto a support. As the binder which can be used in forming the charge generation layer by coating, it can be selected from a wide scope of insulating resins and also from organic photoconductive polymers such as poly-N-vinylcarbazole, polyvinylanthracene, polyvinylpyrene, etc. Preferably, there may be employed insulating resins such as polyvinyl butyral, polyvinyl benzal, polyarylate (polycondensate of bisphenol A and phthalic acid), polycarbonate, polyester, phenoxy resin, polyvinyl acetate, acrylic resin, polyacrylamide, polyamide, polyvinylpyridine, cellulose type resin, urethane resin, casein, polyvinyl alcohol, polyvinyl pyrrolidone, etc. The resin to be contained in the charge generation layer may be suitably 80% by weight or less, preferably 40% by weight or less.

The solvent for dissolving these resins may differ depending on the kind of the resin, and also should preferably be selected from those which do not dissolve the charge transport layer or the subbing layer as described below.

Specific examples of the organic solvent may include alcohols such as methanol, ethanol, isopropanol, etc.; ketones such as acetone, methyl ethyl ketone, methyl isobutyl ketone, dichlorohexanone and the like; amides such as N,N-dimethylformamide, N,N-dimethylacetamide; sulfoxides such as dimethylsulfoxide, etc.; ethers such as tetrahydrofuran, dioxane, ethyleneglycol monomethyl ether, etc.; esters such as methyl acetate, ethyl acetate, and the like; aliphatic halogenated hydrocarbons such as chloroform, methylene chloride, dichloroethylene, carbon tetrachloride, trichloroethylene, etc.; aromatics such as benzene, toluene, xylene, monochlorobenzene, dichlorobenzene; and so on.

Coating can be practiced by use of coating techniques such as dip coating, spray coating, spinner coating, bead coating, Meyer bar coating, blade coating, roller coating, curtain coating, etc.

Drying may be preferably finger touch drying at room temperature, followed by heating drying. Heating drying can be practiced stationarily or under air stream at 30° to 200° C. within a time for 5 minutes to 2 hours.

The charge transport layer is electrically connected to the charge generation layer as described above, receiving charge carriers injected from the charge generation layer under the presence of electrical field and also having the function of being capable of transporting these charge carriers to the surface. In this case, the charge transport layer may be laminated on the charge generation layer, or alternatively therebeneath.

As the charge transport substance, there are electron transport substances and positive hole transport substances. Examples of electron transport substances may include electron attracting substances such as chloroanil, bromoanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone, 2,4,8-trinitrothioxanthone, etc., and polymeric materials obtained from these electron attracting substances.

Examples of positive hole transport substances may include pyrene, N-ethylcarbazole, N-isopropylcarbazole, N-methyl-N-phenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, hydrazones such as p-diethylaminobenzaldehyde-N,N-diphenylhydrazone, p-pyrrolidinobenzaldehyde-N,N-diphenylhydrazone, etc., pyrazolines such as 1-[pyridyl(2)]-3-(α-methyl-p-diethylaminostyryl)-5-(p-diethylaminophenyl) pyrazoline, 1-diphenyl-3-(p-diethylaminostyryl)-4-methyl-5-(p-diethylamino-phenyl)pyrazoline, 1-phenyl-3-(α-benzyl-p-diethylaminostyryl)-5-(p-diethylaminophenyl)-pyrazoline, spiropyrazoline, etc., styryl compounds such as 4-diethylamino-β-naphthylstyrene, 4-diphenylamino-4'-methoxystilbene, etc., oxazole compounds such as 2-(p-diethylaminostyryl)-6-diethylaminobenzoxazole, 2-(p-diethylaminophenyl)-4-(p-dimethylaminophenyl)-5-(2-chlorophenyl)oxazole, etc., thiazole compounds such as 2-(p-diethylaminostyryl)-6-diethylaminobenzothiazole, etc.; triarylmethane compounds such as bis(4-diethylamino-2-methylphenyl)-phenylmethane, polyarylalkanes such as 1,1-bis(4-N,N-diethylamino-2-methylphenyl)heptane, 1,1,2,2-tetrakis(4-N,N-dimethylamino-2-methylphenyl)ethane, etc., triphenylamine, poly-N-vinylcarbazole, polyvinylpyrene, polyvinylanthracene, polyvinylacridine, poly-9-vinylanthracene, pyreneformaldehyde resin, ethylcarbazole-formaldehyde resin, etc.

Other than these organic charge transport substances, inorganic materials such as selenium, selenium-tellurium, amorphous silicon, cadmium sulfide, etc. can be also used.

Also, these charge transport substances can be used either singly or as a combination of two or more kinds.

When the charge transport substance has no film forming property, coating can be formed by selection of a suitable binder. The resin useful as the binder may include, for example, insulating resins such as acrylic resin, polyarylate, polyester, polycarbonate, polystyrene, acrylonitrile-styrene copolymer, acrylonitrile-butadiene copolymer, polyvinyl butyral, polyvinyl formal, polysulfone, polyacrylamide, polyamide, chlorinated rubber, etc. or organic photoconductive polymers such as poly-N-vinylcarbazole, polyvinylanthracene, polyvinylpyrene, etc.

The charge transport layer has the limit which can transport the charge carriers and therefore it cannot be made thicker than is necessary. Generally, it may be 5 to 30 μm, but preferably 10 to 25 μm. In forming the charge transport layer by coating, suitable coating methods as mentioned above can be used.

The photosensitive layer comprising a laminated structure of such charge generation layer and charge transport layer is provided on an electroconductive support. As the electroconductive support, there may be employed supports having themselves electroconductivity such as aluminum, aluminum alloys, copper, zinc, stainless steel, vanadium, molybdenum, chromium, titanium, nickel, indium, gold, platinum, etc., or otherwise plastics having coatings of aluminum, aluminum alloys, indium oxide, tin oxide, indium oxide-tin oxide alloys, etc. formed by vacuum vapor deposition method thereon (e.g. polyethylene, polypropylene, polyvinyl chloride, polyethyleneterephthalate, acrylic resin, polyfluoroethylene, etc.), supports having electroconductive particles (e.g. aluminum powder, titanium oxide, tin oxide, zinc oxide, carbon black, silver particles, etc.) coated with a suitable binder onto plastics or the above electroconductive supports, supports having electroconductive particles impregnated into plastic or paper, plastics having electroconductive polymer, etc.

Between the electroconductive support and the photoconductive layer, a subbing layer having the barrier function and the adhesion function can be also provided.

The subbing layer can be formed of casein, polyvinyl alcohol, nitrocellulose, an ethylene-acrylic acid copolymer, a polyamide (e.g. nylon 6, nylon 66, nylon 610, copolymer nylon, alkoxymethylated nylon, etc.), polyurethane, gelatin, aluminum oxide, etc. The subbing layer may have a film thickness which may be suitably 0.1 to 10 μm, preferably 0.5 to 5 μm.

In the case of using a photosensitive member having an electroconductive support, a charge generation layer and a charge transport layer laminated in this order, when the charge transport substance comprises an electron transportable substance, the surface of the charge transport layer is required to be positively charged and, on exposure after charging, the electrons formed in the charge generation layer are injected into the charge transport layer, and thereafter reach the surface to neutralize the positive charges, whereby attenuation of surface potential occurs to give rise to an electrostatic contrast between the unexposed portion and the exposed portion.

The electrostatic latent image thus formed is developed with a negatively chargeable toner to give a visible image. This image can be directly fixed, or after transfer of the toner image onto paper or plastic film, it can be developed and fixed.

Also, there may be adopted the method in which the electrostatic latent image on the photosensitive member is transferred onto an insulating layer of a transfer paper, followed by developing and fixing. As to the kind of developer, the developing method, the fixing method, any of the known agents and the known methods may be employed and not particularly limited to specific ones.

On the other hand, when the charge transport substance comprises a positive hole transportable substance, the surface of the charge transport layer is required to be negatively charged, and on exposure after charging, the positive holes generated in the charge generation are injected into the charge transport layer at the exposed portion and thereafter reach the surface to neutralize the negative charges, whereby attenuation of the surface potential occurs to give rise to an electrostatic contrast between the exposed portion and the unexposed portion.

During developing, a positively chargeable toner as opposite to the case when employing an electron transportable substance is required to be used.

In the case of using a photosensitive member having an electroconductive support, a charge transport layer and a charge generation layer laminated in this order, when the charge transport substance comprises an electron transportable substance, the surface of the charge transport layer is required to be negatively charged and, on exposure after charging, the electrons formed in the charge generation layer are injected into the charge transport layer, and thereafter reach the support.

On the other hand, the positive holes formed in the charge generation layer reach the surface to effect attenuation of the surface potential, thereby giving rise to an electrostatic contrast between the exposed portion and the unexposed portion.

The electrostatic latent image thus formed is developed with a positively chargeable toner to give a visible image. This image can be directly fixed, or after transfer of the toner image onto paper or plastic film, it can be developed and fixed.

Also, there may be adopted the method in which the electrostatic latent image on the photosensitive member is transferred onto an insulating layer of a transfer paper, followed by developing and fixing. As to the kind of developer, the developing method, the fixing method, any of the known agents and the known methods may be employed and not particularly limited to specific ones.

In contrast, when the charge transport layer comprises a positive hole transportable substance, the surface of the charge generation layer is required to be negatively charged, and on exposure after charging, the positive holes generated in the charge generation are injected into the charge transport layer at the exposed portion and thereafter reach the support.

On the other hand, the electrons generated in the charge generation layer reach the surface to effect attenuation of the surface potential, whereby an electrostatic contrast is formed between the exposed portion and the unexposed portion. During developing, as contrary to the case of using an electron transportable substance, a negatively chargeable toner is required to be used.

Further, as the electrophotographic photosensitive member, an electrophotographic photosensitive member comprising the azo pigment contained together with a charge transport substance in the same layer can be employed.

In this case, in addition to the above charge transport substance, a charge migration complex compound comprising poly-N-vinylcarbazole and trinitrofluorenone can be used.

The electrophotographic photosensitive member of this example can be prepared by dispersing the azo pigment as described above and the charge migration complex compound in tetrahydrofuran, followed by formation of a coating.

In any electrophotographic photosensitive member, the pigment to be used contains at least one pigment selected from the azo pigments having organic residues represented by the formula (I), and its crystal form may be either amorphous or crystalline.

Also, if necessary, a pigment with different light absorption can be used in combination to enhance sensitivity of the photosensitive member, or for the purpose of obtaining a panchromatic photosensitive member, two or more kinds of the azo pigments having the organic residues represented by the above formula (I) can be used in combination, or they can be also be used in combination with charge generation subsances selected from known dyes and pigments.

The electrophotographic photosensitive member of the present invention can be used for electrophotographic copying machines, and otherwise for a large number of electrophotographic application fields of digitial recording systems by use of near infra-red light sources such as electrophotographic copying machines for digital use, laser beam printer, CRT printers, LED printers, liquid crystal printers, laser plate making, etc.

EXAMPLES 1–21

On an aluminum plate was applied an aqueous ammonia solution of casein (casein 11.2%, ammonia water 1 g, water 222 ml) by a Meyer bar to a film thickness after drying of 1.0 μm, followed by drying.

Next, 5 g of the above Exemplary pigment (2)–1 was added into a solution of 2 g of a butyral resin (butyral formation degree 63 mol %) dissolved in 95 ml of ethanol, and dispersed by a sand mill for 2 hours. The dispersion was applied by a Meyer bar on the casein layer previously formed to a film thickness after drying of 0.5 μm, followed by drying, to form a charge generation layer.

Next, 5 g of p-diethylaminobenzaldehyde-N-α-naphthyl-N-phenylhydrazone and 5 g of a polymethyl methacrylate (number average molecular weight 100,000) were dissolved in 70 ml of benzene, and the resultant solution was applied on the charge generation layer by a Meyer bar to a film thickness after drying of 19 μm, followed by drying, to form a charge transport layer, thus preparing an electrophotographic photosensitive member of Example 1.

By use of the Exemplary pigments shown below as the azo pigment in place of the Exemplary pigment (2)–1, following otherwise the same conditions as in Example 1, electrophotographic photosensitive members corresponding to Examples 2–21 were prepared.

The electrophotographic photosensitive members thus prepared were subjected to corona charging at −5.5 KV according to the static system by means of an electrostatic copying paper testing device (Model SP-428, produced by Kawaguchi Denki K. K.) and after maintained in a dark place for 1 second, exposed to light at a luminance of 2 lux for examination of the charging characteristics.

As the charging characteristic, the surface potential (Vo) and the exposure dose necessary for attenuating the potential to 1/2 after dark decay for one second (E1/2) were measured. The results are shown below.

| Example | Exemplary pigment | Vo (−V) | E ½ (lux · sec) |
|---|---|---|---|
| 1 | (2) - 1 | 720 | 1.8 |
| 2 | (2) - 2 | 700 | 1.9 |
| 3 | (1) - 11 | 680 | 2.8 |
| 4 | Synthesis example 2 pigment | 690 | 1.6 |
| 5 | (2) - 3 | 710 | 1.6 |
| 6 | (2) - 9 | 690 | 1.5 |
| 7 | (2) - 17 | 700 | 2.2 |
| 8 | (2) - 18 | 730 | 1.7 |
| 9 | (2) - 19 | 710 | 1.5 |
| 10 | (2) - 29 | 700 | 2.0 |
| 11 | (2) - 32 | 690 | 1.6 |
| 12 | (2) - 35 | 730 | 2.0 |
| 13 | (2) - 36 | 710 | 2.3 |
| 14 | (2) - 48 | 720 | 1.8 |
| 15 | (2) - 92 | 710 | 1.9 |
| 16 | (2) - 44 | 690 | 1.3 |
| 17 | (2) - 53 | 700 | 1.8 |

-continued

| Example | Exemplary pigment | Vo (−V) | E ½ (lux · sec) |
|---|---|---|---|
| 18 | (2) - 70 | 700 | 1.9 |
| 19 | (3) - 1 | 710 | 1.6 |
| 20 | (3) - 8 | 720 | 1.4 |
| 21 | (4) - 2 | 700 | 1.8 |

COMPARATIVE EXAMPLES

Photosensitive members were prepared in entirely the same manner as in Example 1 except for changing the azo pigment in Example 1 to the azo pigments of the formulae shown below, and the results measured are shown.

Pigments used in Comparative examples: The pigments used in the Comparative example Comparative example 1

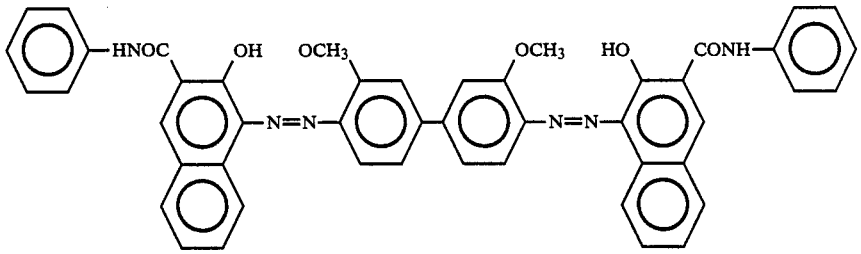

Comparative example 2

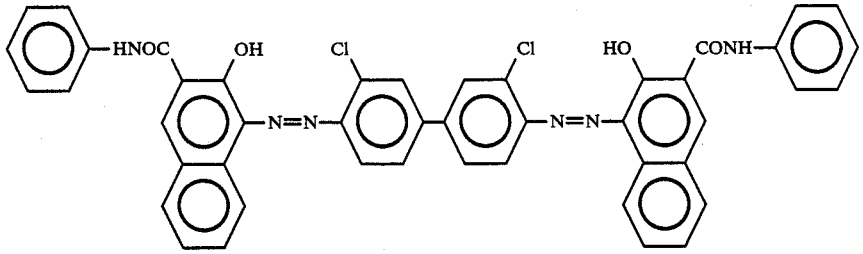

Comparative example 3

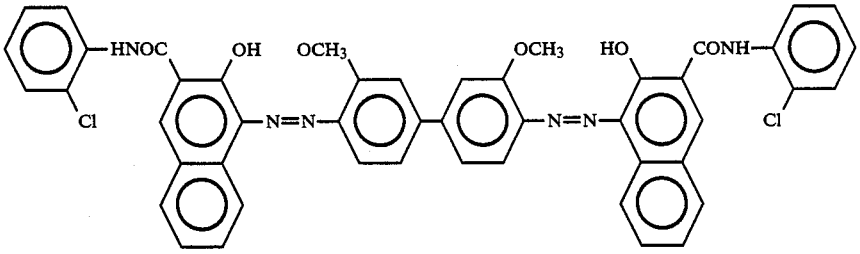

Comparative example 4

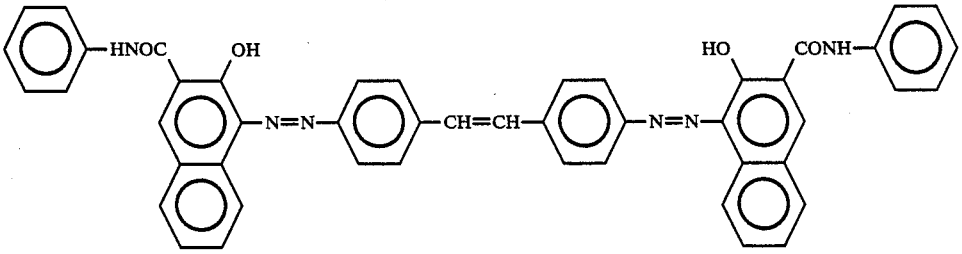

Comparative example 5

-continued
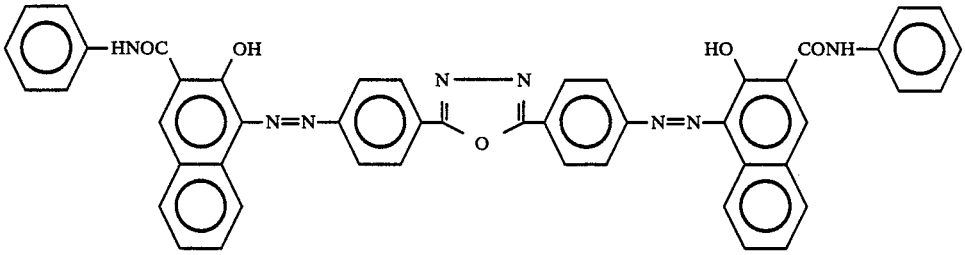
Comparative example 6
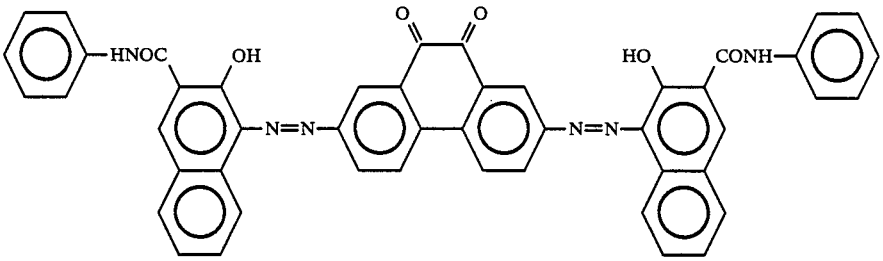
Comparative example 7
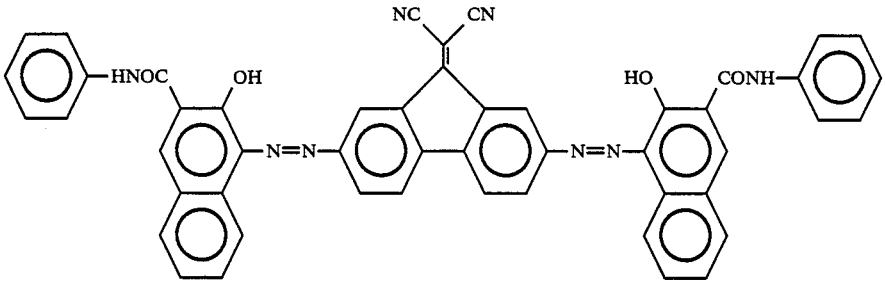
Comparative example 8
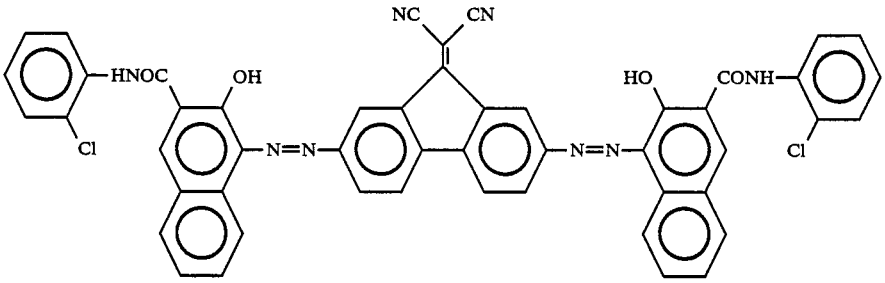
Comparative example 9
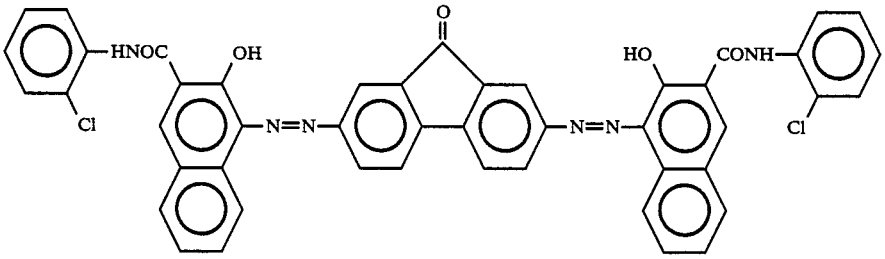
Comparative example 10

-continued
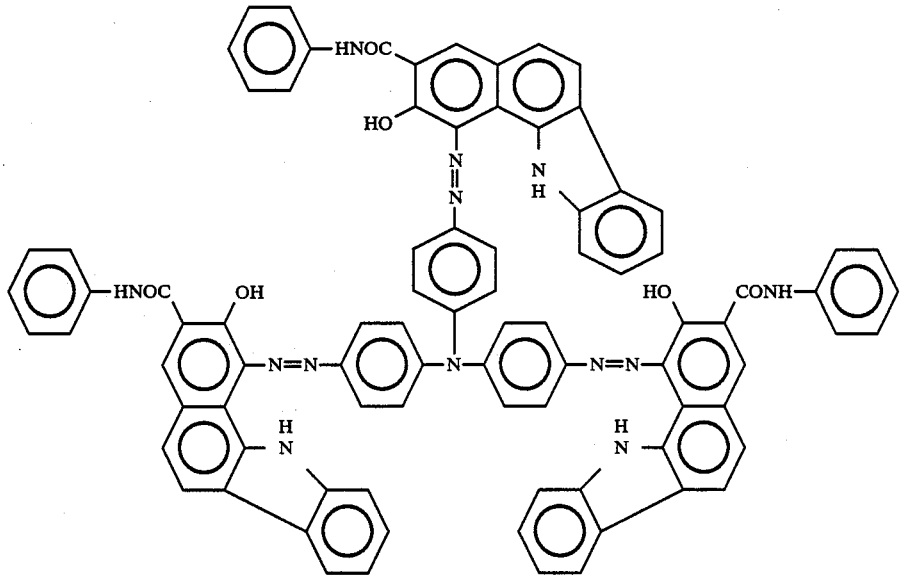
Comparative example 11
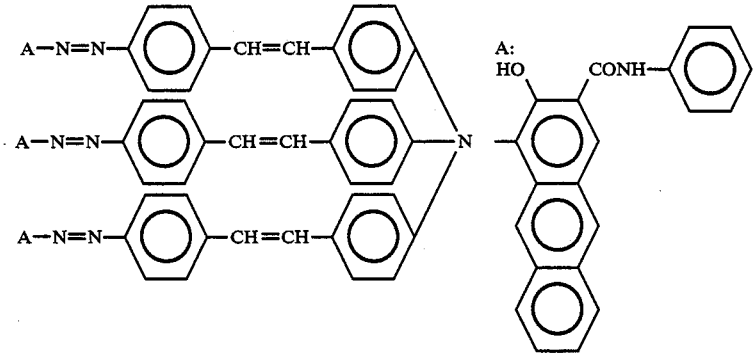
Comparative example 12
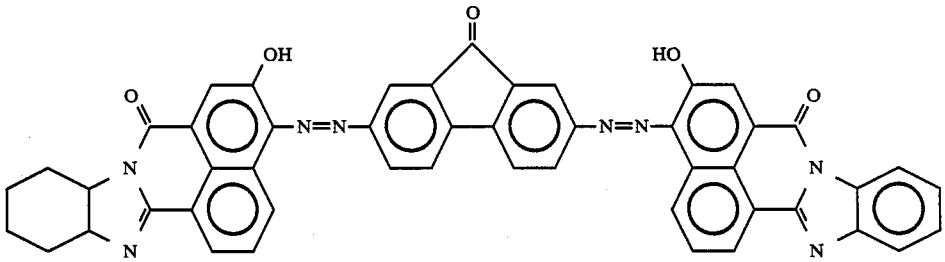
Comparative example 13
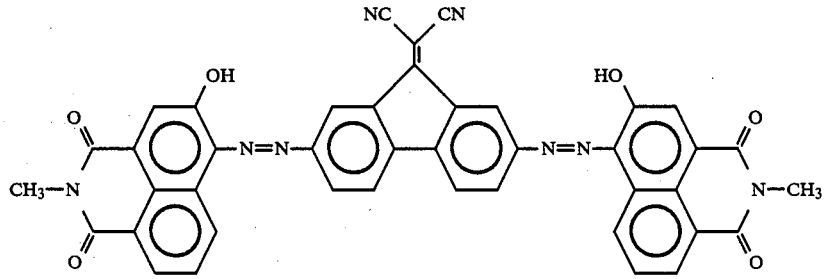
Comparative example 14

-continued

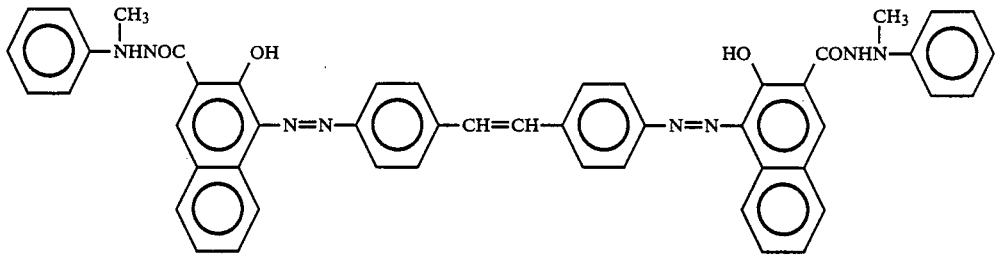

Comparative example 15

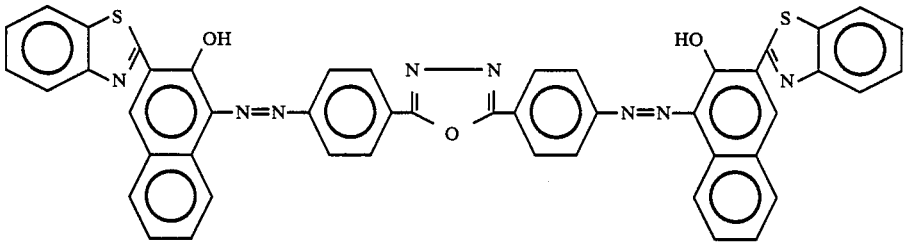

| Comparative example | Vo (−V) | E ½ (lux · sec) |
|---|---|---|
| 1 | 700 | 6.8 |
| 2 | 750 | 7.0 |
| 3 | 700 | 6.1 |
| 4 | 720 | 6.8 |
| 5 | 720 | 6.5 |
| 6 | 400 | 6.0 |
| 7 | 350 | 4.0 |
| 8 | 450 | 4.2 |
| 9 | 660 | 5.8 |
| 10 | 700 | 3.8 |
| 11 | 700 | 3.7 |
| 12 | 670 | 5.5 |
| 13 | 530 | 8.8 |
| 14 | 710 | 7.8 |
| 15 | 700 | 5.6 |

From the above results, it can be recognized that the electrophotographic photosensitive members have all sufficient charging ability and sensitivity.

Further, by use of the electrophotographic photosensitive members prepared in Examples 1, 5, 8, 10, 17 and 19, fluctuations at the light portion potential and the dark portion potential during repeated uses were measured.

Measurement was conducted according to the method, in which the photosensitive member was attached onto a cylinder of an electrophotographic copying machine provided with a corona charger of −5.5 KV, an exposure optical system, a developer, a transfer charger, a deelectrification exposure optical system and a cleaner. The copying machine has a constitution such that an image can be obtained on a transfer paper with driving of the cylinder.

By use of the copying machine, by setting the initial light portion potential ($V_L$) and the dark portion potential ($V_D$) at around −100 V and −700 V, respectively, the light portion potential ($V_L$) and the dark portion potential ($V_D$) after used for 5,000 times were measured. The results are shown below.

| Photosensitive member | Initial $V_D$ (−V) | Initial $V_L$ (−V) |
|---|---|---|
| Example 1 | 700 | 100 |
| Example 5 | 690 | 110 |
| Example 8 | 600 | 90 |

-continued

| | | |
|---|---|---|
| Example 10 | 690 | 100 |
| Example 17 | 710 | 90 |
| Example 19 | 700 | 100 |

| Photosensitive member | After successive copying for 5,000 times $V_D$(−V) | After successive copying for 5,000 times $V_L$(−V) |
|---|---|---|
| Example 1 | 710 | 120 |
| Example 5 | 700 | 120 |
| Example 8 | 680 | 110 |
| Example 10 | 690 | 110 |
| Example 17 | 700 | 110 |
| Example 19 | 690 | 130 |

When the repeated potential characteristics were evaluated for the photosensitive member prepared in Comparative example 6 according to the same method as described above, they were changed as follows:

Initial potentials:

$V_D$: −700 V, $V_L$: −100 V

After successive copying for 5000 times:

$V_D$: −600 V, $V_L$: −240 V.

From the above results, it could be recognized that the electrophotographic photosensitive members of the present invention are all excellent in stability of potential during repeated uses.

EXAMPLES 22–34

An amount of 5 g of the above Exemplary pigment (2)–53 was added into a solution of 2 g of a benzal resin (synthesized from benzal and a Poval with a polymerization degree of 500, benzal formation degree 70%) dissolved in 95 ml of methyl isobutyl ketone, and dispersed in a sand mill for 4 hours. The dispersion was applied by a Meyer bar to a film thickness after drying of 0.5 μm, followed by drying, to form a charge generation layer.

Next, 5 g of a stilbene type compound of the stuctural formula:

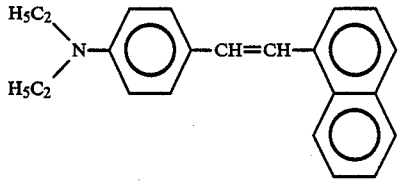

and 5 g of a polymethyl methacrylate (number average molecular weight 100,000) were dissolved in 70 ml of benzene, and the solution was applied by a Meyer bar on the charge generation layer to a thickness after drying of 19 μm, followed by drying, to form a charge transport layer, thus preparing an electrophotographic photosensitive member of Example 22.

By use of the Exemplary pigments shown below as the azo pigment in place of the Exemplary pigment (2)-53, and following otherwise the same conditions as in Example 22, electrophotographic photosensitive members corresponding to Examples 23-34 were prepared.

The electrophotographic photosensitive members thus prepared were subjected to corona discharging at −5.5 KV according to the static system by means of an electrostatic copying paper testing device (the modified machine of the foregoing SP-428) with the semiconductor laser of 780 nm and its scanning unit being replaced with a tungsten light source), maintained in a dark place for one second, followed by exposure to laser beam, for examination of the charging characteristics.

As the charging characteristics, the surface potential (Vo) and the exposure dose necessary for attenuating the potential after dark decay for 1 second to 1/5 (E1/5) were measured. The results are shown below.

| Example | Examplary pigment | Vo (−V) | E 1/5 (μJ/cm²) |
|---|---|---|---|
| 22 | (2) - 46 | 720 | 8.0 |
| 23 | (2) - 70 | 710 | 7.0 |
| 24 | (2) - 30 | 700 | 7.9 |
| 25 | (2) - 76 | 730 | 7.6 |
| 26 | (2) - 82 | 680 | 7.8 |
| 27 | (2) - 89 | 700 | 8.2 |
| 28 | (2) - 101 | 720 | 6.9 |
| 29 | (2) - 106 | 710 | 7.4 |
| 30 | (3) - 1 | 700 | 7.3 |
| 31 | (3) - 2 | 690 | 7.5 |
| 32 | (3) - 15 | 690 | 7.4 |
| 33 | (3) - 9 | 680 | 7.8 |
| 34 | (4) - 4 | 700 | 8.0 |

From the above results, it can be clearly seen that the electrophotographic photosensitive members of the present invention all have practically sufficient sensitivity and potential characteristics relative to laser beam.

EXAMPLE 35

On the charge generation layer prepared in Example 1, a coating solution prepared by dissolving 5 g of 2,4,7-trinitro-9-fluorenone and 5 g of a poly-4,4'-dioxydiphenyl-2,2-propanecarbonate (molecular weight 300,000) dissolved in 70 ml of tetrahydrofuran was coated to a coated amount of 10 g/m² after drying, followed by drying.

The electrophotographic photosensitive member thus prepared was subjected to measurement of charging characteristics in the same manner as in Example 1.

The charging polarity at this time was made +. The results are shown below.

Vo: +680 V

E1/2: 3.6 lux.sec.

EXAMPLE 36

On an aluminum cylinder was coated an aqueous ammonia solution of casein (casein 11.2%, ammonia water 1 g, water 222 ml) according to the dip coating method, followed by drying, to form a subbing layer with a coated amount of 1.0 g/m².

Next, 1 part by weight of the above Exemplary pigment (2)-100, 1 part by weight of a butyral resin (trade name, S-LEC BM-2, produced by Sekisui Kagaku K. K.) and 30 parts by weight of isopropyl alcohol were dispersed in a ball mill for 4 hours.

The dispersion was coated onto the subbing layer previously coated according to the dip coating method and dried to form a charge generation layer. The film thickness was 0.3 μm.

Next, 1 part by weight of 4-diphenylamino-4'-methoxystilbene, 1 part by weight of a polysulfone (trade name P1700, produced by UCC Co.) and 6 parts by weight of monochlorobenzene were mixed and dissolved under stirring in a stirring machine.

The resultant solution was coated onto the charge generation layer according to the dip coating method and dried to form a charge transport layer. The film thickness was 14 μm.

The electrophotographic photosensitive member thus prepared was subjected to corona discharging of −5 KV. The surface potential at this time was measured (initial potential Vo). Further, the surface potential after leaving the photosensitive member to stand in a dark place for 5 seconds was measured (dark decay $V_K$).

Sensitivity was evaluated by measuring the exposure dose necessary for attenuating the potential $V_K$ after dark decay to 1/2 (E1/2, μJ/cm²).

In this case, as the light source, a three-element semiconductor laser of gallium/aluminum/arsenic (output 5 mW, oscillated wavelength 780 nm) was used. The results are shown below.

Vo: −680 V,

Potential retentivity ($V_K$/Vo×100): 90%,

E1/2: 3.4 μJ/cm².

Next, the above photosensitive member was set in place of the photosensitive member of LBP-CX on a laser beam printer (trade name LBP-CX, produced by Canon, Inc.) which is an electrophotographic system printer of the reversal developing system provided with the above semiconductor laser, according to the practical image format test, under the conditions of a surface potential after primary charging of −700 V, a surface potential after image exposure of −150 V (exposure dose 1.2 μJ/cm²), a transfer potential of +700 V, a negative developer polarity, a process speed of 50 mm/sec., developing condition (developing bias) of −450 V, with the image exposure scanning system being image scan, exposure before primary charging being red color whole surface exposure of 50 lux.sec, and the image format being line scanning following the letter signals and image signals, whereby good printing of both letters and images could be obtained.

EXAMPLE 37

On the aluminum surface of a aluminum vapor deposited polyethyleneterephthalate film, a coating of polyvinyl alcohol with a film thickness of 0.5 μm was formed.

Next, the dispersion of the azo pigment used in Example 1 was applied by a Mayer bar on the polyvinyl alcohol layer to a thickness of 0.5 μm after drying and dried to form a charge generation layer.

Next, a solution of 5 g of 1-[pyridyl(2)]-3-(α-methyl-p-diethylaminostyryl)-5-(p-diethylaminophenyl)-pyrazoline and 5 g of a polyarylate (a polycondensate of bisphenol A and terephthalic acidisophthalic acid) dissolved in 70 ml of tetrahydrofuran was applied to a film thickness after drying of 19 μm and dried to form a charge transport layer.

The charging characteristics and the durability characteristics of the electrophotographic photosensitive member thus prepared were measured according to the same methods as described in Example 1. The results are shown below.

Vo: −690,

E1/2: 2.8 lux.sec.

Durability characteristics:

Initial $V_D$: −700, $V_L$: −140 V

After successive copying for 5000 times $V_D$: −715, $V_L$: −160 V.

From the above results, it could be recognized that both sensitivity and potential stability during repeated uses were good.

EXAMPLE 38

On an aluminum plate with a thickness of 100 μm, an aqueous ammonia solution of casein (as described above) was applied and dried to form a subbing layer with a film thickenss of 0.5 μm.

Next, 5 g of 2,4,7-trinitro-9-fluorenone and 5 g of a poly-N-vinylcarbazole (number average molecular weight 300,000) were dissolved in 70 ml of tetrahydrofuran to form a charge migration complex compound.

The charge migration complex compound and 1 g of the Exemplary pigment (2)–52 were added into a solution of 5 g of a polyester (trade name VYLON, produced by Toyobo K. K.) dissolved in 70 ml of tetrahydrofuran to be dispersed therein. The dispersion was applied on the subbing layer to a film thickness of 12 μm after drying and dried. The charging characteristics of the electrophotographic member thus prepared were measured according to the same method as in Example 1. However, the charging polarity was made +. The results are shown below.

Vo: +680,

E1/2: 4.0 lux.sec.

EXAMPLE 39

On the casein layer of the aluminum substrate applied with the casein layer used in Example 1, the same charge transport layer and charge generation layer as in Example 1 were successively laminated to form a photosensitive layer in the same manner except for reversing a layer constitution, thus preparing an electrophotographic photosensitive member.

The charging characteristics were measured according to the same method as in Example 1. However, the charging polarity was made +. The results are shown below.

Vo: +680,

E1/2: 4.2 lux.sec.

Further, when the potential stability during repeated uses was evaluated in the same manner as in Example 37 except for changing the charging polarity to +, the following results were obtained.

Durability characteristics:

Initial $V_D$: +700, $V_L$: +180 V

After successive copying for 5,000 times $V_D$: +685, $V_L$: +185 V.

What is claimed is:

1. An electrophotographic photosensitive member having a photosensitive layer on an electroconductive support, characterized in that the photosensitive member contains an azo pigment having an organic residue represented by the formula:

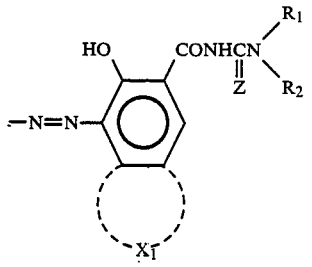

(I)

wherein $X_1$ represents a residue necessary for forming an aromatic hydrocarbon ring or an aromatic heterocyclic ring which may have substituent through fusion with the benzene ring; $R_1$ and $R_2$, which may be identical or different, each represent hydrogen atom, an alkyl, aralkyl, aryl or heterocyclic group which may have substituent, or $R_1$ and $R_2$ represent a cyclic amino group containing the nitrogen atom to which $R_1$ and $R_2$ are bonded within the ring; Z represents oxygen atom or sulfur atom.

2. An electrophotographic photosensitive member according to claim 1, wherein the organic residue represented by formula (I) is represented by the structural formula:

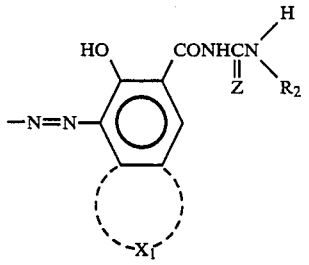

wherein $X_1$ and Z have the same meanings as in the formula (I); $R_2$ represents alkyl, aralkyl or aryl group which may have a substituent.

3. An electrophotographic photosensitive member according to claim 2, wherein $R_2$ in the organic residue represented by the above structural formula is aryl group which may have a substituent.

4. An electrophotographic photosensitive member according to claim 2, wherein $R_2$ in the organic residue represented by the above structural formula is phenyl group which may have a substituent.

5. An electrophotographic photosensitive member according to claim 1, wherein said azo pigment has a structure comprising the organic residue represented by the above formula (I) bonded to an aromatic hydrocarbon ring or an aromatic heterocyclic group which may have substituent which may be bonded through a bonding group.

6. An electrophotographic photosensitive member according to claim 1, wherein said azo pigment is an azo pigment represented by the formula:

(II)

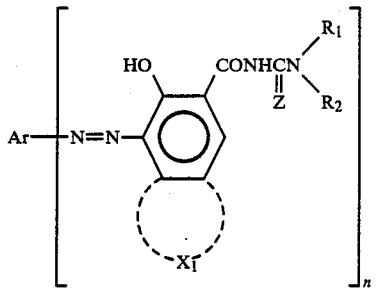

wherein $X_1$, $R_1$, $R_2$ And Z have the same meanings as in the formula (I); Ar represents an aromatic hydrocarbon ring or an aromatic heterocyclic ring which may have substituent which may be bonded through a bonding group; and n represents an integer of 1, 2, 3 or 4.

7. An electrophotographic photosensitive member according to claim 6, wherein the azo pigment represented by the formula (II) has the structural formula:

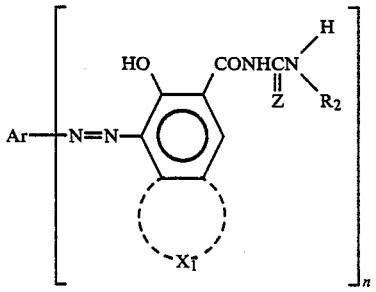

wherein $X_1$, Z, Ar and n have the same meanings as in the formula (II); $R_2$ represents alkyl, aralkyl or aryl group which may have a substituent.

8. An electrophotographic photosensitive member according to claim 7, wherein $R_2$ in the azo pigment represented by the above structural formula is aryl group which may have a substituent.

9. An electrophotographic photosensitive member according to claim 7, wherein $R_2$ in the azo pigment represented by the above structural formula is phenyl group which may have a substituent.

10. An electrophotographic photosensitive member according to claim 1, wherein said azo pigment has a structure comprising at least one organic residue represented by the formula (I) and at least one organic residue different from the above organic residue represented by the formula:

$$-N{=}N-Cp \qquad \text{(III)}$$

wherein Cp represents a coupler residued having phenolic OH group, bonded to an aromatic hydrocarbon ring or an aromatic heterocyclic group which may have substituent which may be bonded through a bonding group.

11. An electrophotographic photosensitive member according to claim 2, wherein said azo pigment has a structure comprising at least one organic residue represented by the formula (I) and at least one organic residue different from the above organic residue represented by the formula:

$$-N{=}N-Cp \qquad \text{(III)}$$

wherein Cp represents a coupler residued having phenolic OH group, bonded to an aromatic hydrocarbon ring or an aromatic heterocyclic group which may have substituent which may be bonded through a bonding group.

12. An electrophotographic photosensitive member according to claim 3, wherein said azo pigment has a structure comprising at least one organic residue represented by the formula (I) and at least one organic residue different from the above organic residue represented by the formula:

$$-N{=}N-Cp \qquad \text{(III)}$$

wherein Cp represents a coupler residued having phenolic OH group, bonded to an aromatic hydrocarbon ring or an aromatic heterocyclic group which may have substituent which may be bonded through a bonding group.

13. An electrophotographic photosensitive member according to claim 4, wherein said azo pigment has a structure comprising at least one organic residue represented by the formula (I) and at least one organic residue different from the above organic residue represented by the formula:

$$-N{=}N-Cp \qquad \text{(III)}$$

wherein Cp represents a coupler residued having phenolic OH group, bonded to an aromatic hydrocarbon ring or an aromatic heterocyclic group which may have substituent which may be bonded through a bonding group.

14. An electrophotographic photosensitive member according to claim 1, wherein the photosensitive layer has a laminated structure of a charge generation layer and a charge transport layer, and the charge generation layer contains said azo pigment.

15. An electrophotographic photosensitive member according to claim 1, wherein the photosensitive layer contains said azo pigment and a charge transporting substance or a charge migration complex compound.

* * * * *